US008313337B2

(12) United States Patent
Tsai

(10) Patent No.: US 8,313,337 B2
(45) Date of Patent: Nov. 20, 2012

(54) ELECTRICAL CONNECTOR

(76) Inventor: Horng Yu Tsai, SinJhuang (TW)

( * ) Notice: Subject to any disclaimer, the term of this patent is extended or adjusted under 35 U.S.C. 154(b) by 0 days.

(21) Appl. No.: 13/111,550

(22) Filed: May 19, 2011

(65) Prior Publication Data

US 2011/0287651 A1 Nov. 24, 2011

(30) Foreign Application Priority Data

May 21, 2010 (TW) ..... 99209714 U
Jun. 24, 2010 (TW) ..... 99212004 U
Feb. 1, 2011 (TW) ..... 100202356 U

(51) Int. Cl.
*H01R 4/50* (2006.01)

(52) U.S. Cl. ..... 439/345

(58) Field of Classification Search ..... None
See application file for complete search history.

(56) References Cited

U.S. PATENT DOCUMENTS 6,478,592 B1 * 11/2002 Hu et al. ..... 439/159
7,172,430 B2 * 2/2007 Kojima ..... 439/64
2008/0254683 A1 * 10/2008 Si et al. ..... 439/610
2009/0098757 A1 * 4/2009 Kimura ..... 439/345

* cited by examiner

*Primary Examiner* — Jean F Duverne
(74) *Attorney, Agent, or Firm* — Pro-Techtor Int'l Services

(57) ABSTRACT

An electrical connector includes a plastic base and at least one row of terminals. The plastic base has a connection slot. The at least one row of terminals are disposed in the plastic base. Each of the terminals is formed by bending a plate surface of a metal sheet, and has an elastic arm, a fixing portion and a pin. The fixing portion is fixed to the plastic base, the elastic arm has a connection point disposed in the connection slot, and the pin extends out of the base. A cut surface of the elastic arm forms the connection point, and the elastic arm elastically moves in a plate surface direction when the connection point is pressed.

33 Claims, 32 Drawing Sheets

ELECTRICAL CONNECTOR

BACKGROUND OF THE INVENTION

1. Field of the Invention

The invention relates to an electrical connector with the better effect of scratching an oxide layer during the electrical connection.

2. Related Art

Referring to FIG. 1, a conventional DDR SO DIMM electrical connector includes a base 10, one row of lower terminals 15 and one row of upper terminals 20. The base 10 has a connection slot 11. The lower terminal 15 has an elastic arm 16, a fixing portion 17 and a pin 18. The fixing portion 17 is fixed to the base 10. The elastic arm 16 has a projecting connection point disposed in the connection slot 11. The upper terminal 20 has an elastic arm 21, a fixing portion 22 and a pin 23. The fixing portion 22 is fixed to the base 10. The elastic arm 21 has a projecting connection point 24 disposed in the connection slot 11. The connection point 24 of the upper terminal 20 is disposed above and behind a connection point 19 of the lower terminal 15.

Each of the lower terminal 15 and the upper terminal 20 is formed by pressing a metal plate. So, the connection points 19 and 24 are in the state of cut-surface contact so that the better effect of scratching the oxide layer during the electrical connection is obtained. However, the terminal is formed by pressing a metal plate, so the continuous terminals cannot be formed, the material is wasted, and the assembling processes are time-consumptive.

As shown in FIG. 2, a conventional PCI-E electrical connector has a base 10, one row of lower terminals 15 and one row of upper terminals 20. The base 10 has a connection slot 11. The lower terminal 15 has an elastic arm 16, a fixing portion 17 and a pin 18. The fixing portion 17 is fixed to the base 10. The elastic arm 16 has a projecting connection point disposed in the connection slot 11. The upper terminal 20 has an elastic arm 21, two fixing portions 26 and 27 with different heights, and a pin 23. The fixing portions 26 and 27 are fixed to the base 10. The elastic arm 21 has a projecting connection point 24 disposed in the connection slot 11. The connection point 24 of the upper terminal 20 is disposed above and behind the connection point 19 of the lower terminal 15.

Each of the lower terminal 15 and the upper terminal 20 is formed by bending a plate surface of a metal plate, so the continuous terminals can be formed, the material is saved and the assembling processes are labor-saving. However, the connection point 19/24 is in the form of the projecting arced plate surface, and the effect of scratching the oxide layer during the electrical connection is poor.

SUMMARY OF THE INVENTION

It is therefore a main object of the invention to provide an electrical connector having a terminal formed by bending a plate surface of a metal sheet, and a connection point formed by a cut surface of an elastic arm, so that the better effect of scratching the oxide layer is obtained, the continuous terminals can be formed, the manufacturing material is saved and the assembling processes are labor-saving.

Another object of the invention is to provide an electrical connector having at least one row of terminals and one row of elastic pressing sheets, all of which are formed by bending the plate surface of the metal sheet. This is different from the conventional C-shaped terminal formed by pressing a plate, and the continuous terminals can be manufactured by way of pressing to save the cost.

Still another object of the invention is to provide an electrical connector having a connection point of a terminal, which is a natural arc with a radius or a burrless chamfer formed by way of punching.

Yet still another object of the invention is to provide an electrical connector having a plastic base housed by a metal casing, wherein one row of elastic pressing sheets and the metal casing are integrally formed, so that the plastic base may be made thinner to satisfy the miniaturized product requirement.

Yet still another object of the invention is to provide an electrical connector, wherein each of two sides of a rear section of an elastic arm of a terminal connected to the connection point is a natural arc with a radius or a burrless chamfer formed during punching.

To achieve the above-identified objects, the invention provides an electrical connector including a plastic base and at least one row of terminals. The plastic base has a connection slot. The at least one row of terminals are disposed in the plastic base. Each of the terminals is formed by bending a plate surface of a metal sheet, and has an elastic arm, a fixing portion and a pin. The fixing portion is fixed to the plastic base, the elastic arm has a connection point disposed in the connection slot, and the pin extends out of the base. A cut surface of the elastic arm forms the connection point, and when the connection point is pressed, the elastic arm elastically moves in a plate surface direction.

In the electrical connector, the connection point of the terminal is one edge connected between a distal-end cut surface and a plate surface of the elastic arm of the terminal.

In the electrical connector, the connection point of the terminal is a natural arc with a radius or a burrless chamfer formed during punching.

In the electrical connector, each of two sides of the rear section of the elastic arm connected to the connection point is a natural arc with a radius or a burrless chamfer formed during punching.

In the electrical connector, an opening of the connection slot faces frontwards, and a cable may be inserted into the connection slot through the opening. The cable has one row of connection points and further has one row of elastic pressing sheets. Each elastic pressing sheet has an elastic arm, which may elastically tightly press against the cable. The elastic arms of the at least one row of terminals and the elastic arms of the one row of elastic pressing sheets respectively tightly press against top and bottom surfaces of the cable.

The elastic arms of the at least one row of terminals and the elastic arms of the one row of elastic pressing sheets elastically move in the direction toward the plate surface when they are pressed by the cable.

The electrical connector further includes a metal casing covering the plastic base, wherein the one row of elastic pressing sheets and the metal casing are integrally formed by pressing a metal material.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1:
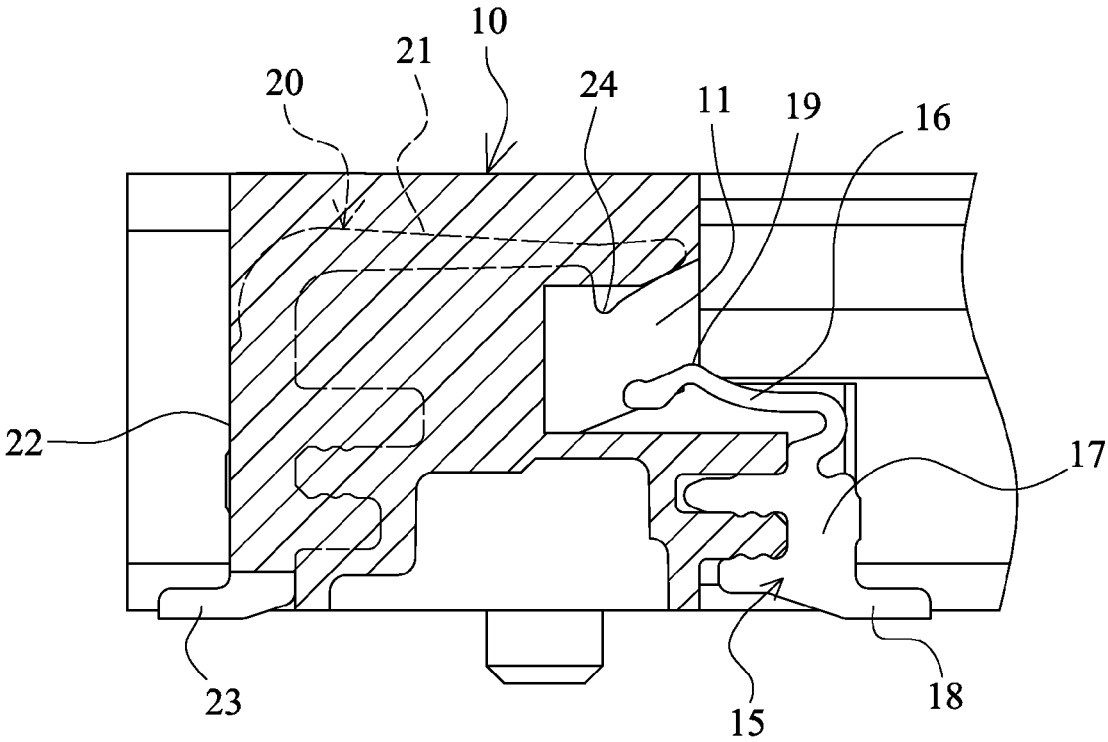
FIG. 1 (Prior Art)
FIG. 1 is a cross-sectional side view showing a conventional electrical connector.
Figure 2:
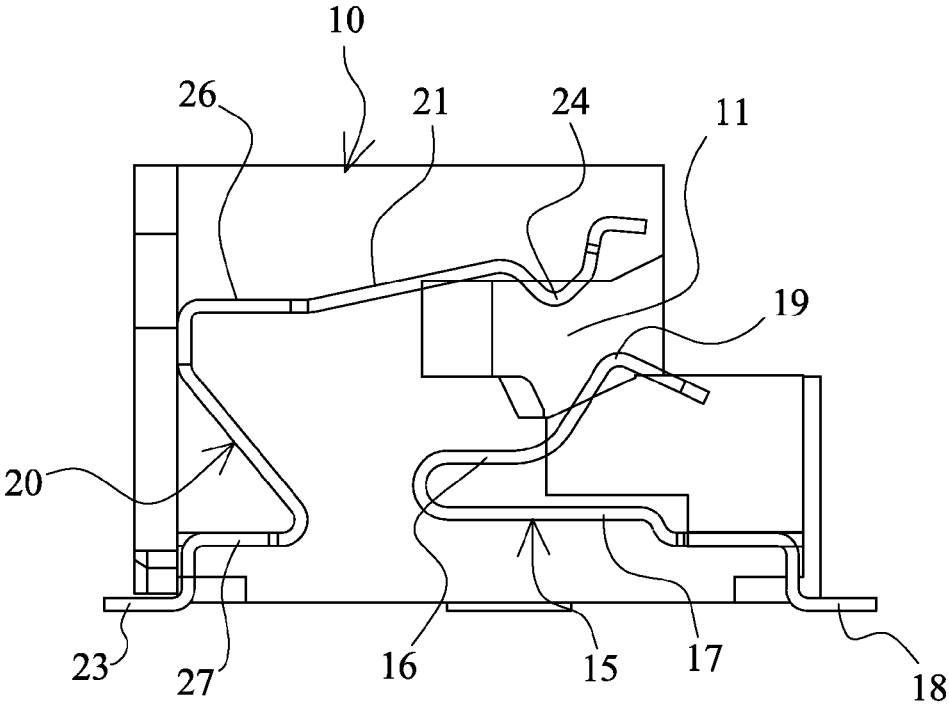
FIG. 2 (Prior Art)
FIG. 2 is a perspective side view showing the conventional electrical connector.
Figure 3:
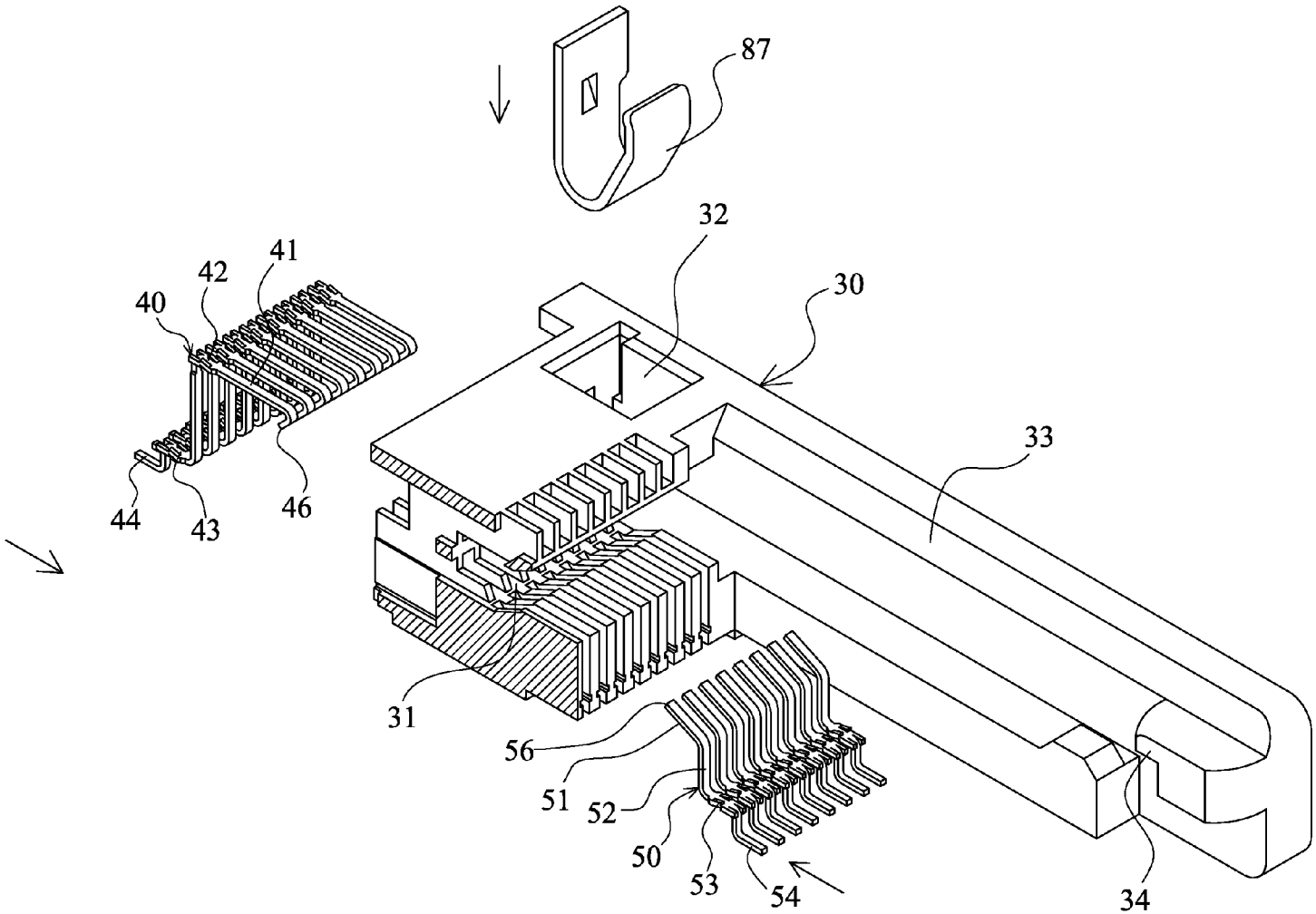
FIG. 3 is a pictorially exploded view showing a first embodiment of the invention.
Figure 4:
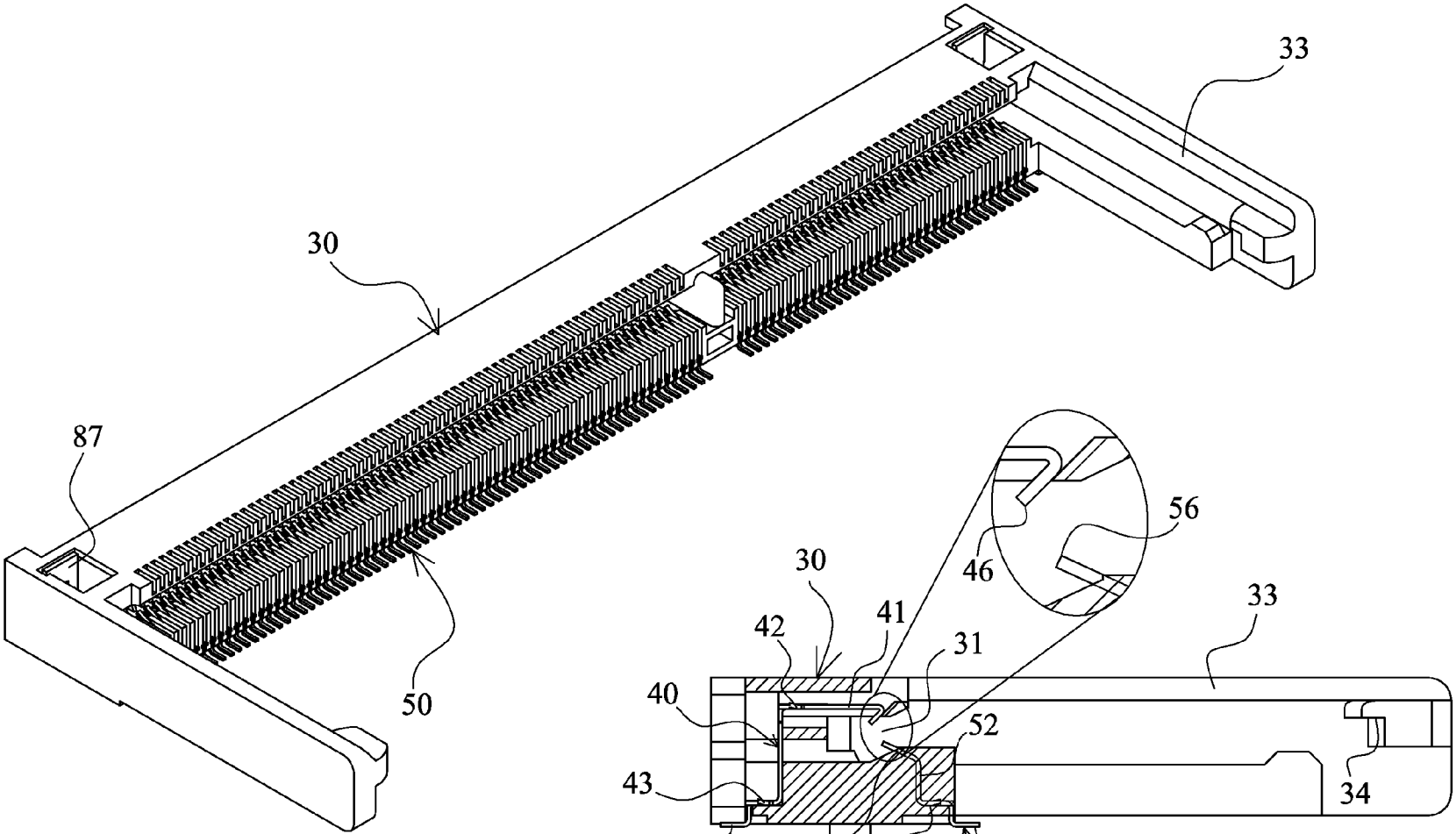
FIG. 4 is a pictorially assembled view showing the first embodiment of the invention.
Figure 5:
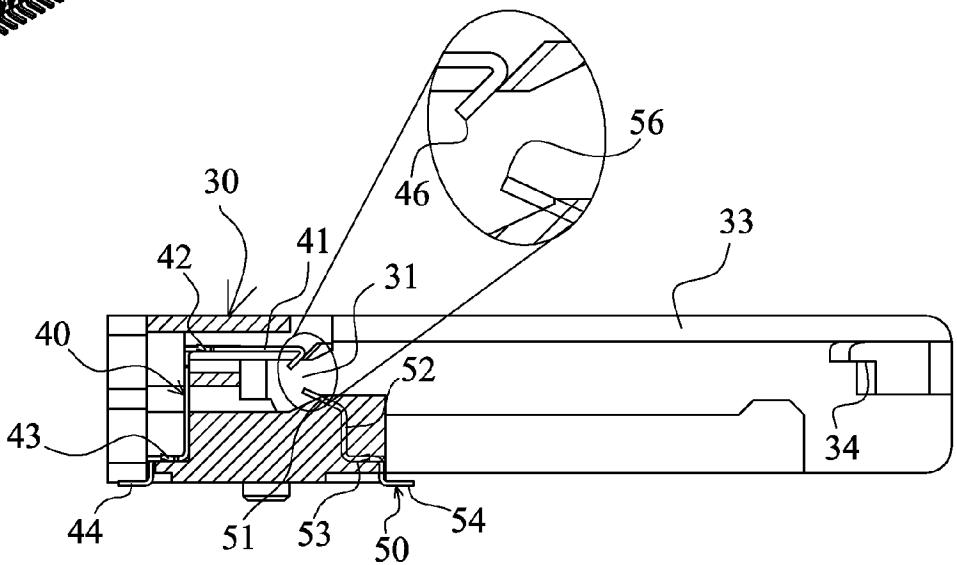
FIG. 5 is a cross-sectional side view showing the first embodiment of the invention.

Referring to FIGS. 3 to 5, the electrical connector according to the first embodiment of the invention is a DDR SO DIMM electrical connector including a plastic base 30, one row of first terminals 40, one row of second terminals 50 and a card-ejecting elastic sheet 87.

The plastic base 30 has a connection slot 31 with an opening facing frontwards. Each of two sides of the plastic base 30 has a card-ejecting elastic sheet slot 32 communicating with the connection slot 31, and one lateral arm 33. The two lateral arms 33 extend in the direction toward the opening of the connection slot. A fastener 34 is disposed near an outer end of each of the two lateral arms 33. When a circuit board (an electrical device) is inserted into the connection slot for positioning, the fastener 34 may engage with one side of the circuit board.

The first terminal 40 is formed by bending a plate surface of a metal sheet, and sequentially has, from one end to the other end, an elastic arm 41, two fixing portions 42 and 43 and a pin 44. The elastic arm 41 has one end connected to the fixing portion 42. The two fixing portions 42 and 43 are horizontal, located at different levels and fixed to the plastic base 30. The pin 44 horizontally extends out of a rear end of a bottom surface of the plastic base 30. The elastic arm 41 extends toward the opening of the connection slot, and the rear section of the elastic arm 41 is bent downwards and away from the opening of the connection slot 31. The bent portion of the elastic arm 41 has no elasticity and is formed with a connection point 46 projecting mostly downwards. The connection point 46 is disposed on a free end of the elastic arm 41. The connection point 46 is one edge connected between the distal-end cut surface of the elastic arm 41 and the plate surface of the elastic arm and is in the form of one tip point and projecting toward the connection slot 31. When the connection point 46 is pressed, the elastic arm 41 elastically moves in the direction toward the plate surface.

The second terminal 50 is formed by bending the plate surface of one metal sheet, and sequentially has, from one end to the other end, a transversal elastic arm 51, a longitudinal elastic arm 52, a fixing portion 53 and a pin 54. The fixing portion 53 is fixed to the plastic base 30. The pin 54 horizontally extends out of the front end of the bottom surface of the plastic base 30. The transversal elastic arm 51 extends slantingly upwards and has a distal end formed with a connection point 56 upwardly projecting toward the connection slot 31. The connection point 56 is one edge connected between the distal-end cut surface of the transversal elastic arm 51 and the plate surface of the transversal elastic arm and is in the form of a tip point.

The connection point 46 of the first terminal 40 is disposed above and behind the connection point 56 of the second terminal 50.

The card-ejecting elastic sheet 87, disposed in the card-ejecting elastic sheet slot 32, has a U shape and one end extending to the connection slot 31.

Figure 6:
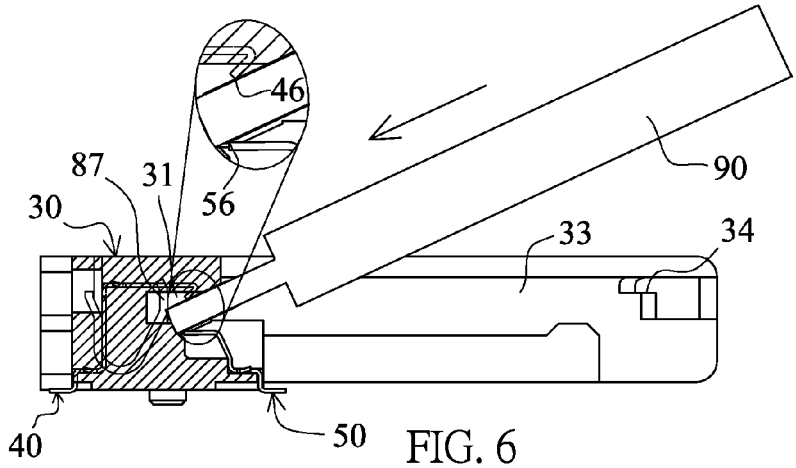
FIG. 6 shows the usage state of the first embodiment of the invention.
Figure 7:
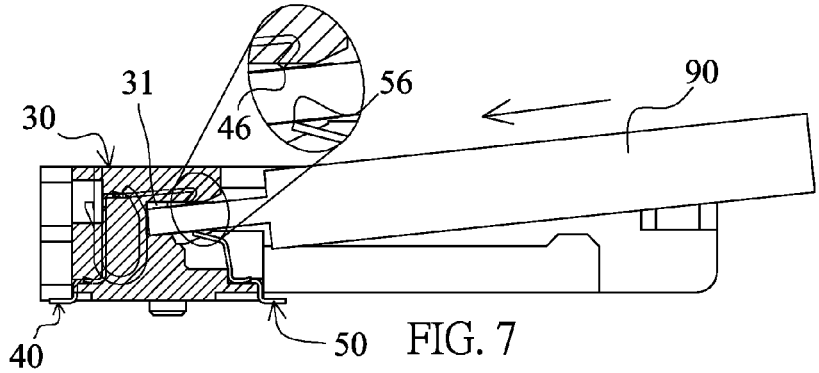
FIG. 7 shows the usage state of the first embodiment of the invention.
Figure 8:
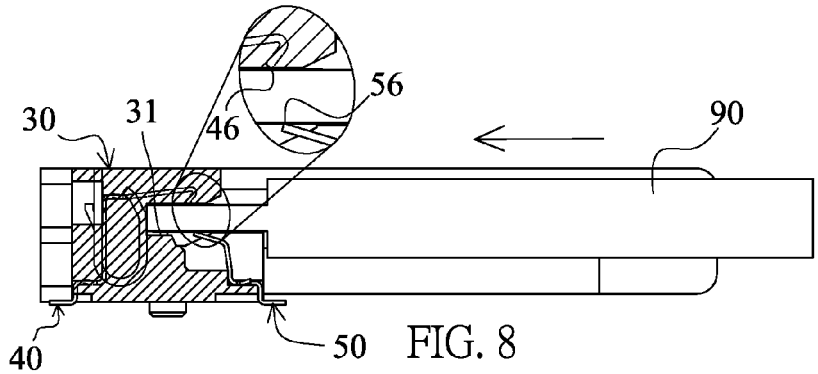
FIG. 8 shows the usage state of the first embodiment of the invention.
Figure 9:
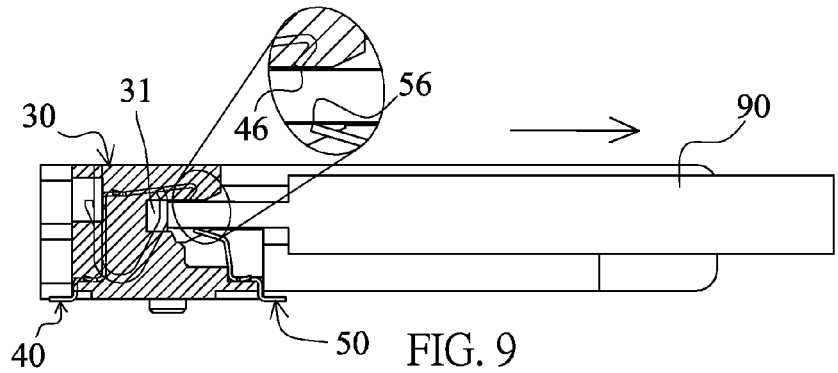
FIG. 9 shows the usage state of the first embodiment of the invention.

As shown in FIG. 6, a circuit board 90 is slantingly inserted into the connection slot 31, and the golden fingers on one end of the circuit board may contact with the connection points 46 and 56 of the first and second terminals 40 and 50. As shown in FIGS. 7 and 8, when the circuit board 90 is again pushed, it can compress the card-ejecting elastic sheet 87. As shown in FIG. 9, when the force of pushing the circuit board 90 is released, the card-ejecting elastic sheet 87 rebounds to push out the circuit board 90 by a stroke, and the two sides of the other end of the circuit board 90 engage with the fasteners 34 of the two lateral arms 33. At this time, the golden fingers on one end of the circuit board can be scratched by the connection points 46 and 56 of the first and second terminals 40 and 50 by a stroke to achieve the better effect of scratching the oxide layer.

Each of the connection points 46 and 56 of the first and second terminals of this embodiment is the natural arc with a radius R (also referred to as an R-corner) or the burrless chamfer formed during punching. In addition, each of two sides of the rear section of the elastic arm connecting to the connection points 46 and 56 is a natural R-corner or a burrless chamfer formed during punching. Thus, the poor contact, caused by the rugged burr, cannot occur during the electrical connection, wherein the burrless chamfer may be a circular arc surface or a 45-degree cut surface.

When the terminal is being punched, one edge of the cut surface forms the natural R-corner, while the other edge thereof forms the rugged burr. So, this embodiment may be implemented in the following manner. Herein, the second terminal will be described as an example, and the first terminal may be implemented similarly.

Figure 10:
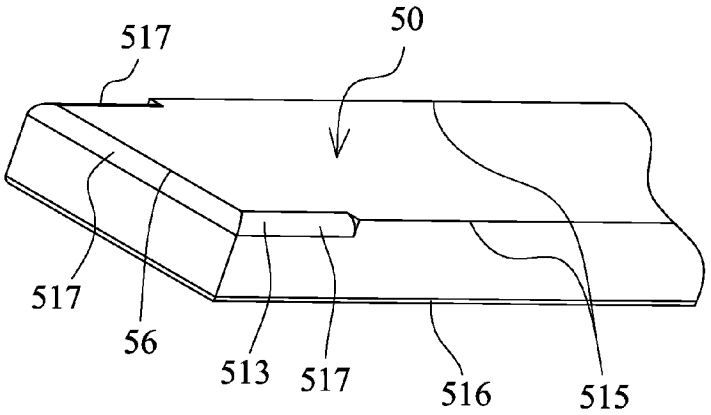
FIG. 10 is a pictorial view showing a second terminal according to the first embodiment of the invention.
Figure 10A:
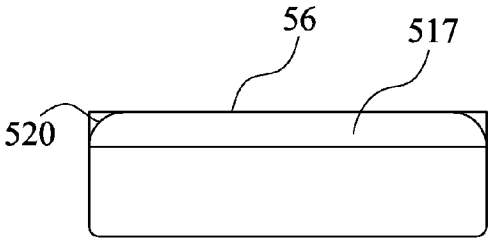
FIG. 10A is a plane view showing a distal end of the second terminal according to the first embodiment of the invention.

As shown in FIGS. 10 and 10A, if one edge of the cut surface of the second terminal 50 having the connection point 56 is a burr 515 and the other edge thereof is a natural R-corner 516, then the burr of the connection point 56 has to be removed to form a chamfer 517, and the burrs on the two sides 513 of the rear section of the transversal elastic arm of the connection point 56 have to be removed to form the chamfers 517. In addition, the middle of the distal-end cut surface of the elastic arm is a most upwardly projecting projection, which is the connection point 56, and two edges 520 are arced downwards.

Figure 11:
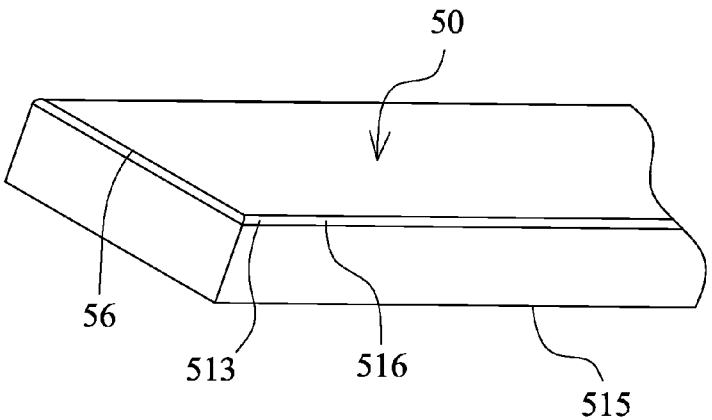
FIG. 11 is a pictorial view showing the second terminal according to the first embodiment of the invention.

As shown in FIG. 11, if one edge of the cut surface of the second terminal 50 having the connection point 56 is the natural R-corner 516 and the other edge thereof is the burr 515, then the connection point 56 and the two sides 513 connected to the rear section of the transversal elastic arm of the connection point 56 are natural R-corners to have the good contact, and need not to be chamfered.

Figure 12:
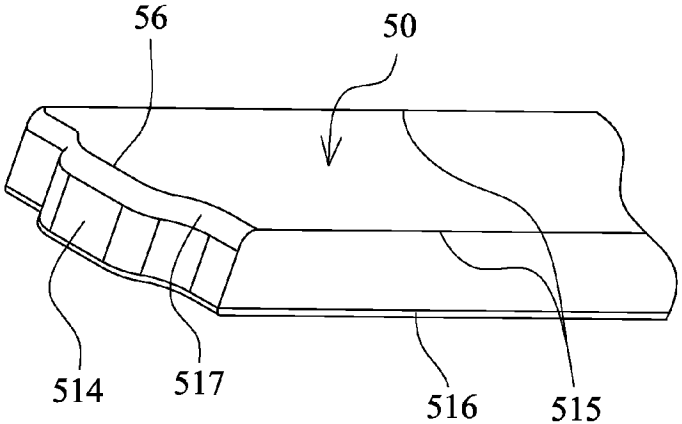
FIG. 12 is a pictorial view showing the second terminal according to the first embodiment of the invention.
Figure 12A:
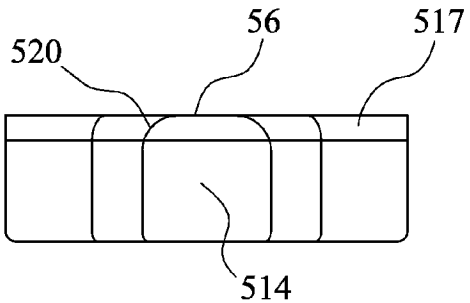
FIG. 12A is a plane view showing the distal end of the second terminal according to the first embodiment of the invention.

As shown in FIGS. 12 and 12A, if one edge of the cut surface of the second terminal 50 having the connection point 56 is the burr 515, the other edge thereof is the natural R-corner 516, and the middle of the distal-end cut surface of the transversal elastic arm is a backwardly projecting projection 514, then the burr of the one edge of the distal-end cut surface of the transversal elastic arm having the connection point 56 is removed to form the chamfer 517. In addition, the middle of the distal-end cut surface of the elastic arm is the most upwardly projecting projection, which is the connection point 56, and the two edges 520 are arced downwards.

Figure 13:
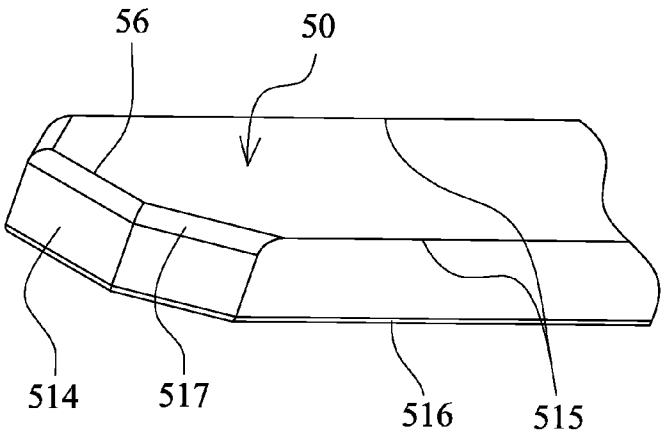
FIG. 13 is a pictorial view showing the second terminal according to the first embodiment of the invention.
Figure 13A:
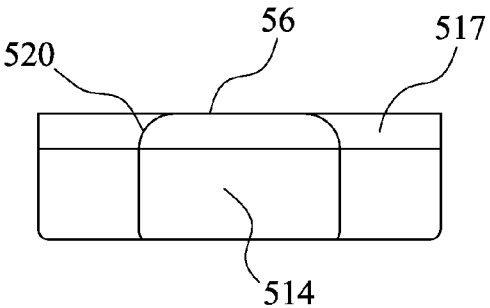
FIG. 13A is a plane view showing the distal end of the second terminal according to the first embodiment of the invention.

As shown in FIGS. 13 and 13A, if one edge of the cut surface of the second terminal 50 having the connection point 56 is the burr 515, the other edge thereof is the natural R-corner 516, and the middle of the distal-end cut surface of the transversal elastic arm is the backwardly projecting projection 514, then the burr of the one edge of the distal-end cut surface of the transversal elastic arm having the connection point 56 is removed to form the chamfer 517. In addition, the middle of the distal-end cut surface of the elastic arm is the most upwardly projecting projection, which is the connection point 56, and the two edges 520 are arced downwards.

According to the above-mentioned description, the advantages of the invention may be concluded in the following.

First, the invention terminal is formed by bending the plate surface of the metal sheet, so that the continuous terminals can be formed, the manufacturing material can be saved, and the assembling processes are labor-saving.

Second, the distal-end cut surface of the elastic arm of the invention terminal forms the connection point to achieve the better effect of scratching the oxide layer.

Third, the connection point of the invention terminal is the distal-end cut surface of the elastic arm and is the natural R-corner (arc with the radius R) or burrless chamfer formed during punching. In addition, each of two sides of the rear section of the elastic arm connected to the connection point is also the natural R-corner or burrless chamfer formed during punching. Thus, the poor contact, caused by the rugged burr, cannot occur during the electrical connection.

Figure 14:
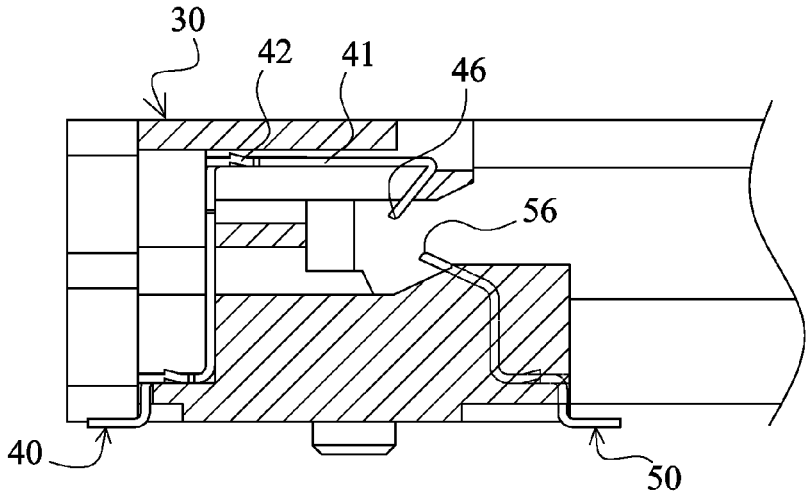
FIG. 14 is a cross-sectional side view showing a second embodiment of the invention.

As shown in FIG. 14, the second embodiment of the invention is substantially the same as the first embodiment except for the difference that the connection points 46 and 56 of the first and second terminals 40 and 50 are distal-end cut surfaces of the elastic arms and have circular arc surfaces.

Figure 15:
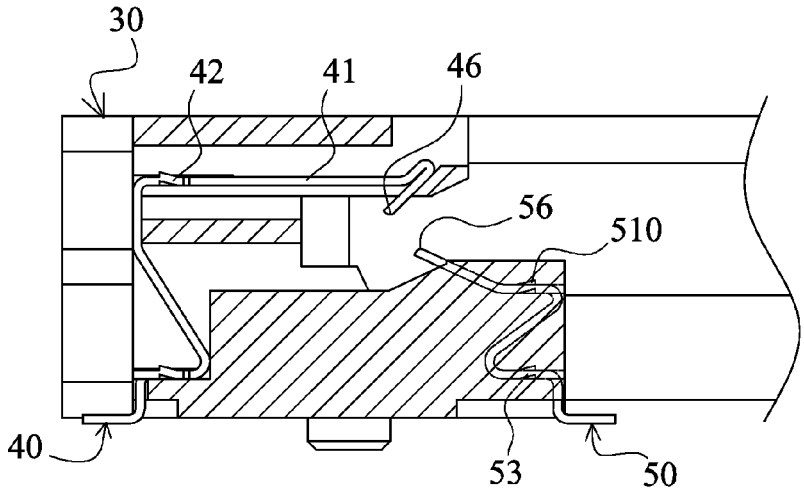
FIG. 15 is a cross-sectional side view showing a third embodiment of the invention.

As shown in FIG. 15, the third embodiment of the invention is almost the same as the second embodiment except for the difference that a higher fixing portion 42 of the first terminal 40 is disposed behind that of the second embodiment. Thus, the elastic arm 41 may be longer. In addition, the second terminal 50 further has a fixing portion 510 higher than the fixing portion 53.

Figure 16:
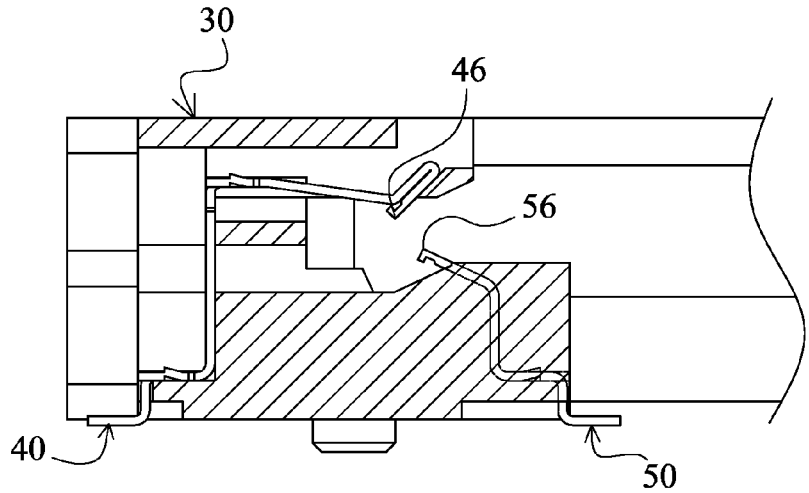
FIG. 16 is a cross-sectional side view showing a fourth embodiment of the invention.

As shown in FIG. 16, the fourth embodiment of the invention is substantially the same as the first embodiment except for the difference that the connection points 46 and 56 of the first and second terminals 40 and 50 are distal-end cut surfaces of the elastic arms, and are pressed into tip points with the arc radius approaching 0.

Figures 17, 18:
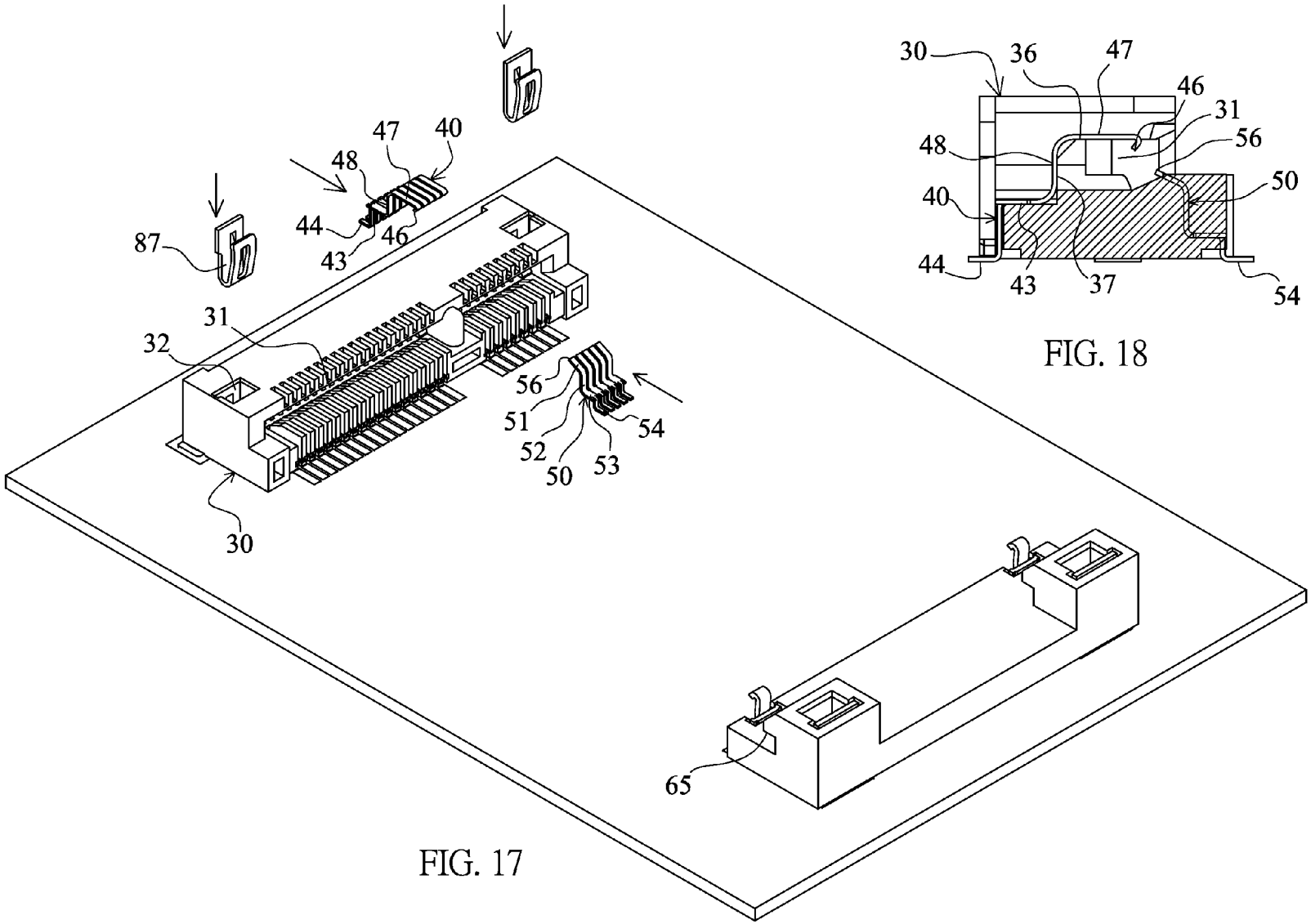
FIG. 17 is a pictorially exploded view showing a fifth embodiment of the invention.
FIG. 18 is a cross-sectional side view showing the fifth embodiment of the invention.

As shown in FIGS. 17 and 18, the fifth embodiment of the invention is a MINI PCI-E electrical connector including a plastic base 30, one row of first terminals 40, one row of second terminals 50, a card-ejecting elastic sheet 87 and a hook 65.

The plastic base 30 has the connection slot 31 with an opening facing frontwards, and each of two sides of the plastic base 30 has a card-ejecting elastic sheet slot 32 communicating with the connection slot 31. The plastic base has a transversally resting standard plane 36 and a longitudinally resting standard plane 37.

The first terminal 40 is formed by bending the plate surface of the metal sheet, and sequentially has, form one end to the other end, a transversally extending elastic arm 47, a longitudinally extending elastic arm 48, a fixing portion 43 and a pin 44. The fixing portion 43 is horizontally fixed to the plastic base 30. The pin 44 horizontally extends out of the rear end of the bottom surface of the plastic base 30. The rear section of the transversal elastic arm 47 is bent downwards and away from the opening of the connection slot and has a most downwardly projecting connection point 46. The connection point 46 is one edge connected between the distal-end cut surface of the elastic arm 41 and the plate surface of the elastic arm, and is a tip point projecting toward the connection slot 31. The transversal elastic arm 47 of the first terminal slightly exceeds the horizontal plane and has the downward pressure against the transversally resting standard plane 36. The longitudinal elastic arm 48 of the first terminal has the frontward pressure against the longitudinally resting standard plane 37. The resting portions between the plastic base and the transversal elastic arm 47 and the longitudinal elastic arm 48 fall between the fixing portion 43 and the connection point 46.

The second terminal 50 is formed by bending the plate surface of the metal sheet, and sequentially has, from one end to the other end, a transversal elastic arm 51, a longitudinal elastic arm 52, a fixing portion 53 and a pin 54. The fixing portion 53 is fixed to the plastic base 30. The pin 54 horizontally extends out of the front end of the bottom surface of the plastic base 30. The transversal elastic arm 51 extends slantingly upwards and has a distal end formed with the connection point 56 upwardly projecting toward the connection slot 31. The connection point 56 is one edge connected between the distal-end cut surface of the transversal elastic arm 51 and the plate surface of the transversal elastic arm and is a tip point.

The connection point 46 of the first terminal 40 is disposed above and behind the connection point 56 of the second terminal 50.

The card-ejecting elastic sheet 87, disposed in the card-ejecting elastic sheet slot 32, has the U shape and one end extending to the connection slot 31.

The hook 65 is disposed in front of the plastic base 30.

Figure 19:
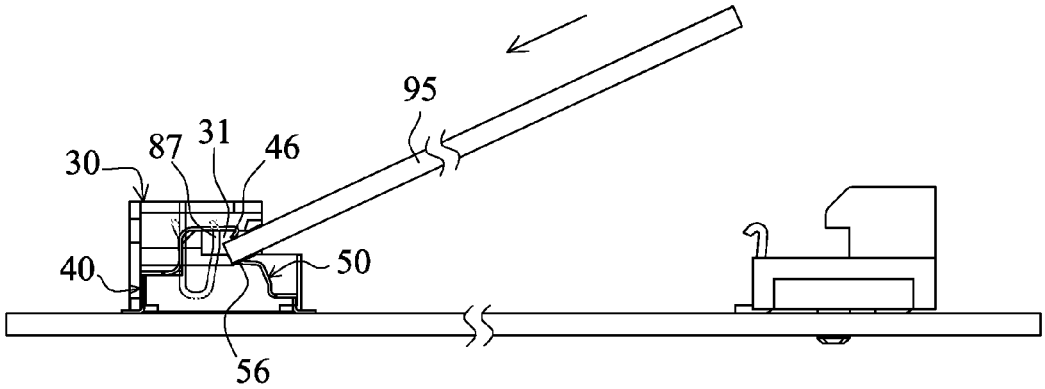
FIG. 19 shows the usage state of the fifth embodiment of the invention.
Figure 20:
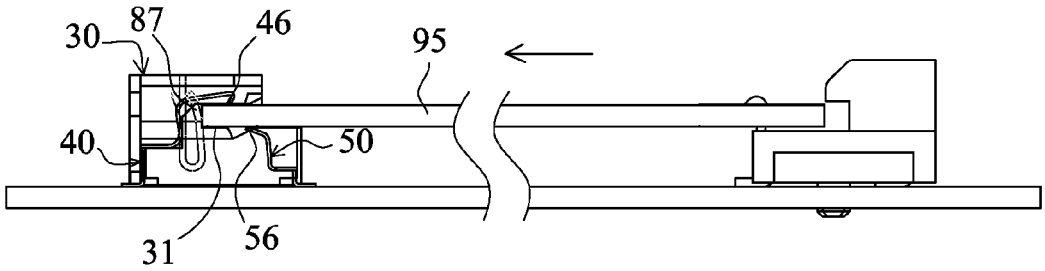
FIG. 20 shows the usage state of the fifth embodiment of the invention.
Figure 21:
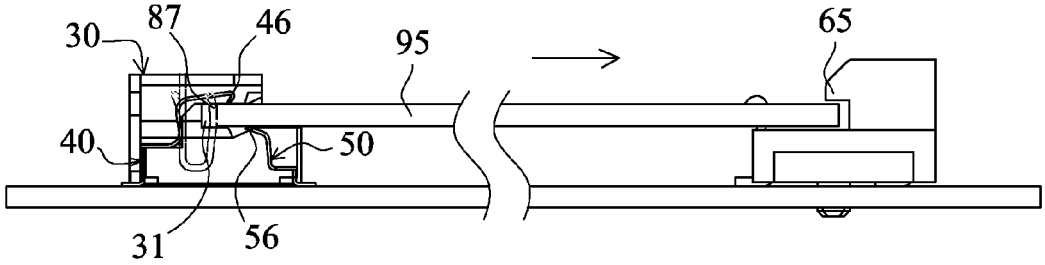
FIG. 21 shows the usage state of the fifth embodiment of the invention.

As shown in FIG. 19, the circuit board 90 being used is slantingly inserted into the connection slot 31, and the golden fingers of one end of the circuit board may contact with the connection points 46 and 56 of the first and second terminals 40 and 50. As shown in FIG. 20, the circuit board 90 is further pushed to compress the card-ejecting elastic sheet 87. As shown in FIG. 21, when the force pressing the circuit board 90 is released, the card-ejecting elastic sheet 87 rebounds to push out the circuit board 90 by a stroke, and the two sides of the other end of the circuit board 90 engage with the hook 65.

Figure 22:
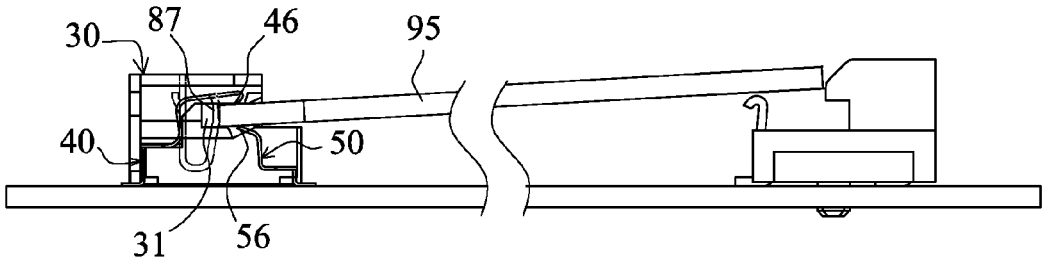
FIG. 22 shows the usage state of a sixth embodiment of the invention.

As shown in FIG. 22, the sixth embodiment of the invention is almost the same as the fifth embodiment except for the difference that the connection points 46 and 56 of the first and second terminals 40 and 50 are aligned in a top-to-bottom manner, so that the circuit board 95 may be inserted in a substantially horizontal manner.

Figure 23:
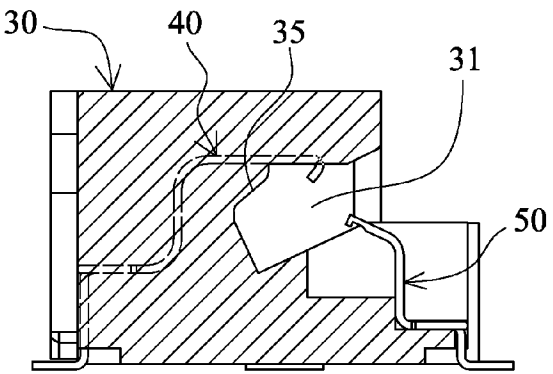
FIG. 23 is a cross-sectional side view showing a seventh embodiment of the invention.

As shown in FIG. 23, the seventh embodiment of the invention is almost the same as the fifth embodiment except for the difference that the inner end of the connection slot 31 of the plastic base 30 has a card-ejecting inclined surface 35. When a circuit board is inserted, it can be ejected by a stroke along the card-ejecting inclined surface 35.

Figure 24:
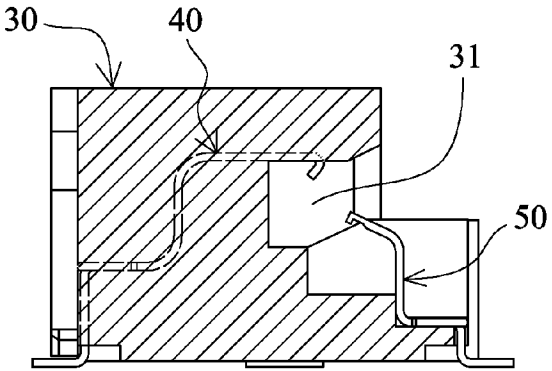
FIG. 24 is a cross-sectional side view showing an eighth embodiment of the invention.

As shown in FIG. 24, the eighth embodiment of the invention is almost the same as the seventh embodiment except for the difference that the plastic base 30 has no card-ejecting elastic sheet and the inner end of the connection slot 31 has no card-ejecting inclined surface.

Figure 25:
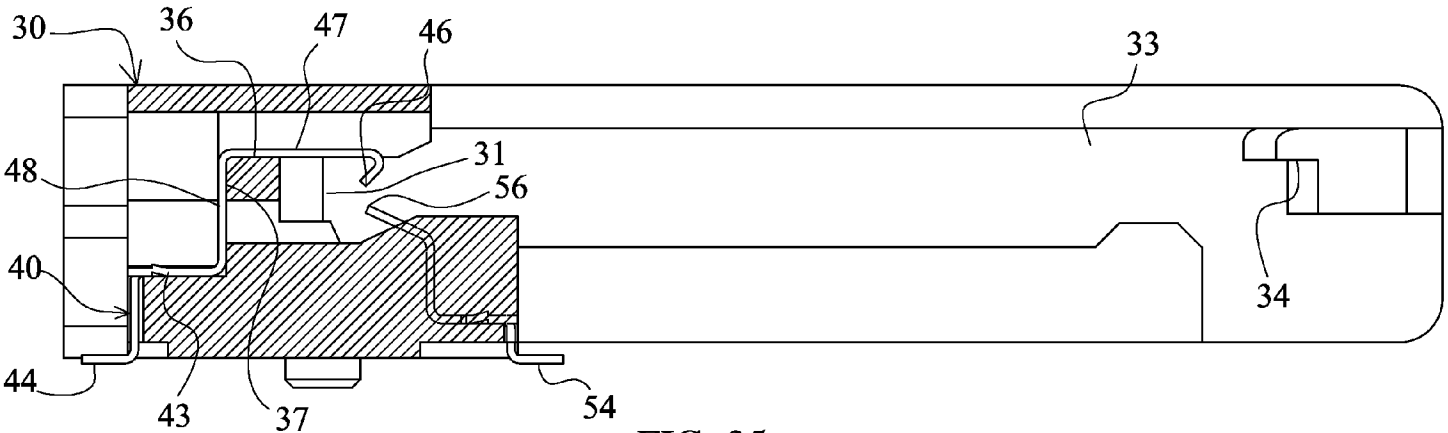
FIG. 25 is a cross-sectional side view showing a ninth embodiment of the invention.

As shown in FIG. 25, the ninth embodiment of the invention is a DDR SO DIMM electrical connector, which is almost the same as the fifth embodiment.

Figure 27:
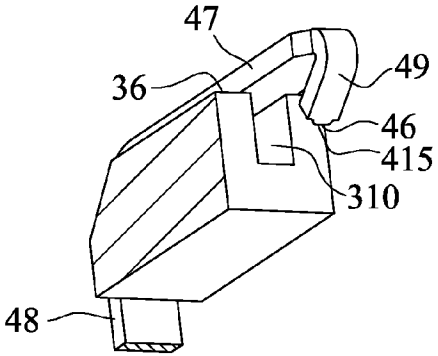
FIG. 27 is a pictorially cross-sectional view showing the tenth embodiment of the invention.
Figure 26:
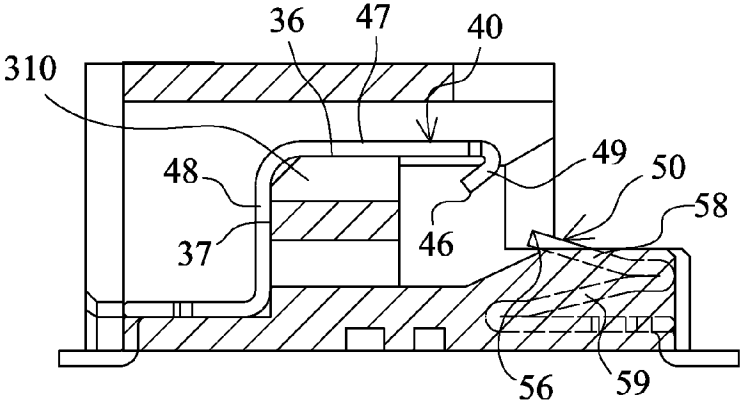
FIG. 26 is a cross-sectional side view showing a tenth embodiment of the invention.

As shown in FIGS. 26 and 27, the tenth embodiment of the invention is almost the same as the first and ninth embodiments except for the difference that the rear section of the transversal elastic arm 47 of the first terminal 40 of this embodiment has a contact section 49, which has the narrower plate surface, is bent downwards and extends backwards. The middle of the distal-end cut surface of the contact section 49 has a projection 415. The edge of the projection 415 forms a most downwardly projecting connection point 46. The middle of the transversally resting standard plane 36 has a cavity 310. The contact section 49 of the transversal elastic arm 47 can fall into the cavity 310. Thus, the first terminal 40 can get out of the way of the plastic base when it is transversally assembled into the plastic base from the backside, and the first terminal can be assembled conveniently. In addition, the second terminal 50 of this embodiment has a first elastic arm 58 and a second elastic arm 59 extending in opposite directions to form a compression spring structure with the excellent elasticity. The distal-end cut surface of the first elastic arm 58 is the connection point 56.

Figure 28:
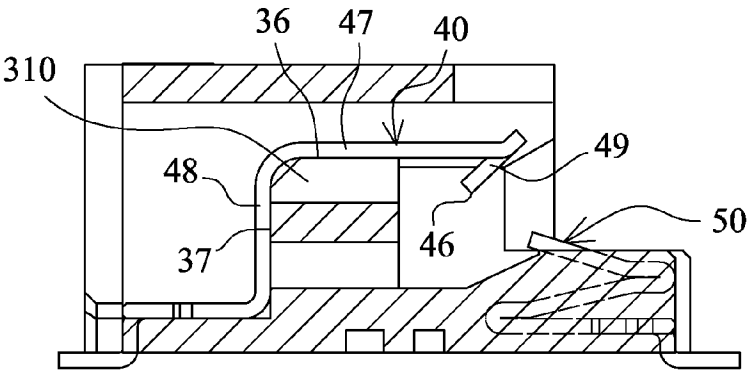
FIG. 28 is a cross-sectional side view showing an eleventh embodiment of the invention.

As shown in FIG. 28, the eleventh embodiment of the invention is almost the same as the tenth embodiment except for the difference that the contact section 49 of the transversal elastic arm 47 of the first terminal 40 of this embodiment is prodded from the plate surface of the transversal elastic arm 47.

Figure 29:
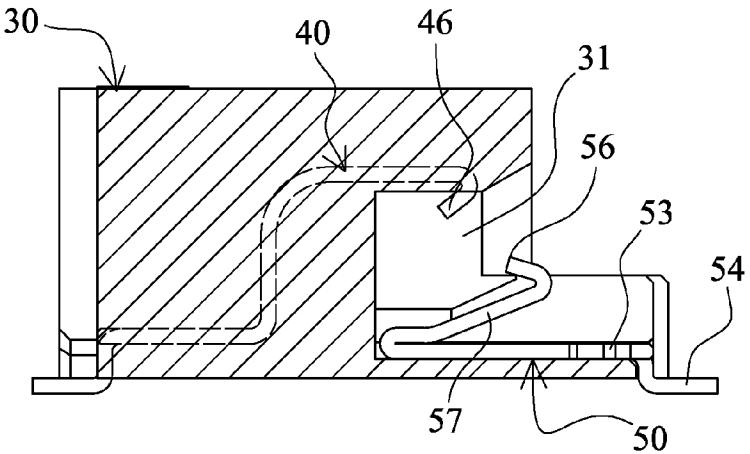
FIG. 29 is a cross-sectional side view showing a twelfth embodiment of the invention.

As shown in FIG. 29, the twelfth embodiment of the invention is almost the same as the fifth embodiment, in which the opening of the connection slot 31 faces frontwards, except for the difference that the second terminal 50 of this embodiment only has one elastic arm 57 facing frontwards and extending upwards, the fixing portion 53 thereof extends horizontally backwards, the elastic arm 57 is bent from the fixing portion 53 and extends frontwards, and the rear section of the elastic arm 57 is bent upwards and away from the opening of the connection slot. The bent portion of the elastic arm 57 has no elasticity and has a most upwardly projecting connection point 56. The connection point 56 is one edge connected between the distal-end cut surface of the elastic arm 57 and the plate surface of the elastic arm 57 and is a tip point projecting toward the connection slot 31. The pin 54 horizontally extends out of the front end of the plastic base 30.

Each of the connection points 46 and 56 of the first and second terminals of this embodiment is the natural R-corner or the burrless chamfer formed during punching. In addition, each of the two sides of the rear section of the elastic arm connected to the connection points 46 and 56 is the natural R-corner or burrless chamfer formed during punching. Thus, the poor contact, caused by the rugged burr, cannot occur during the electrical connection.

When the terminal is being punched, one edge of the cut surface forms the natural R-corner, while the other edge thereof forms the rugged burr. So, this embodiment may be implemented in the following manner. Herein, the second terminal will be described as an example, and the first terminal may be implemented similarly.

Figure 30:
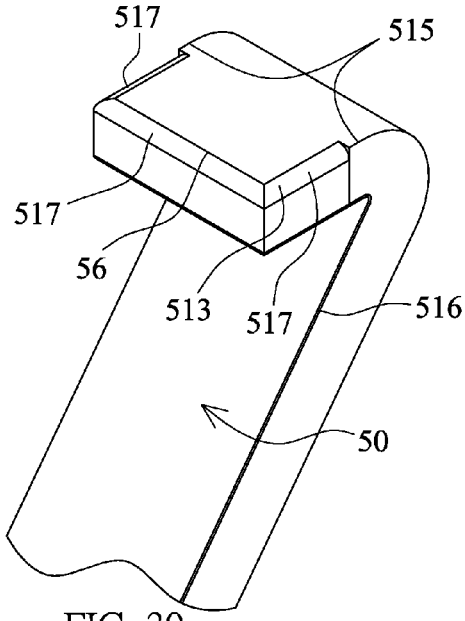
FIG. 30 is a pictorial view showing a second terminal according to the twelfth embodiment of the invention.

As shown in FIG. 30, if one edge of the cut surface of the second terminal having the connection point 56 is a burr 515 and the other edge thereof is a natural R-corner 516, then the burr of the connection point 56 has to be removed to form a chamfer 517, and the burrs on the two sides 513 of the rear section of the elastic arm of the connection point 56 have to be removed to form the chamfers 517. In addition, the middle of the distal-end cut surface of the elastic arm is a most upwardly projecting projection, which is the connection point 56, and two edges are arced downwards.

Figure 31:
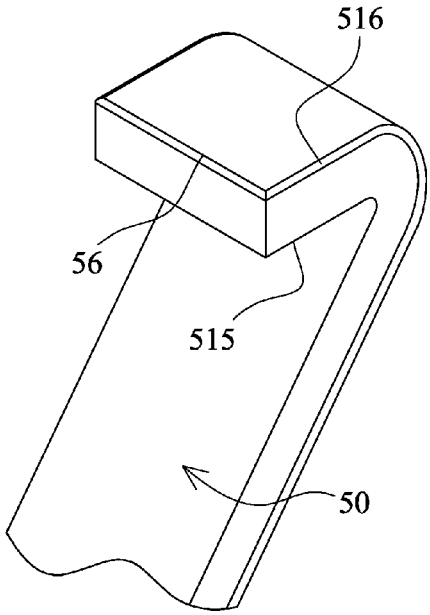
FIG. 31 is a pictorial view showing the second terminal according to the twelfth embodiment of the invention.

As shown in FIG. 31, if one edge of the cut surface of the second terminal having the connection point 56 is the natural R-corner 516 and the other edge thereof is the burr 515, then the connection point 56 and the two sides connected to the rear section of the transversal elastic arm of the connection point 56 are natural R-corners to have the good contact, and need not to be chamfered.

Figure 32:
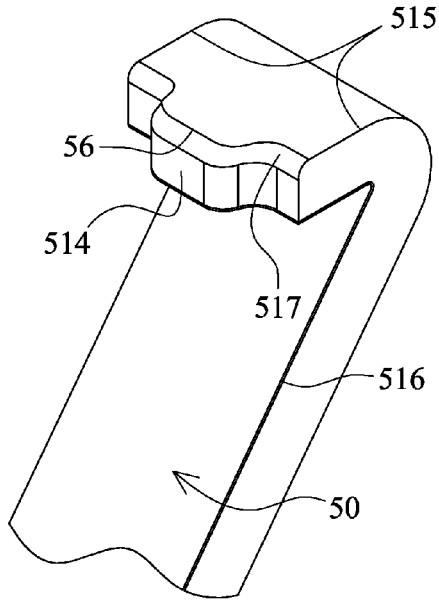
FIG. 32 is a pictorial view showing the second terminal according to the twelfth embodiment of the invention.

As shown in FIG. 32, if one edge of the cut surface of the second terminal having the connection point 56 is the burr 515, the other edge thereof is the natural R-corner 516, and the middle of the distal-end cut surface of the transversal elastic arm is a backwardly projecting projection 514, then the burr of the one edge of the distal-end cut surface of the transversal elastic arm having the connection point 56 is removed to form the chamfer 517. In addition, the middle of the distal-end cut surface of the elastic arm is the most upwardly projecting projection, which is the connection point 56, and the two edges are arced downwards.

Figure 33:
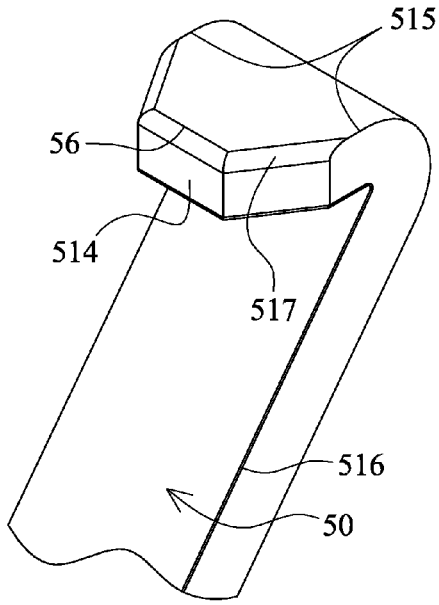
FIG. 33 is a pictorial view showing the second terminal according to the twelfth embodiment of the invention.

As shown in FIG. 33, if one edge of the cut surface of the second terminal having the connection point 56 is the burr 515, the other edge thereof is the natural R-corner 516, and the middle of the distal-end cut surface of the transversal elastic arm is the backwardly projecting projection 514, then the burr of the one edge of the distal-end cut surface of the transversal elastic arm having the connection point 56 is removed to form the chamfer 517. In addition, the middle of the distal-end cut surface of the elastic arm is the most upwardly projecting projection, which is the connection point 56, and the two edges are arced downwards.

Figure 34:
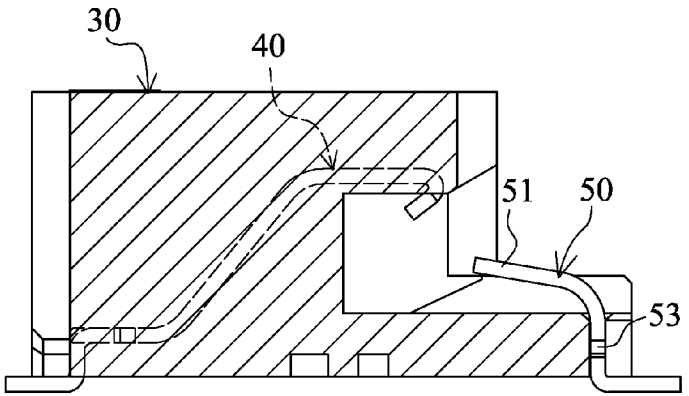
FIG. 34 is a cross-sectional side view showing a thirteenth embodiment of the invention.

As shown in FIG. 34, the thirteenth embodiment of the invention is almost the same as the fifth embodiment except for the difference that the second terminal 50 of this embodiment only has one transversal elastic arm 51 extending backwards and upwards, and the fixing portion 53 of the second terminal 50 extends longitudinally and is fixed to the plastic base 30. The second terminal 50 is assembled to the plastic base 30 from top to bottom.

Figure 35:
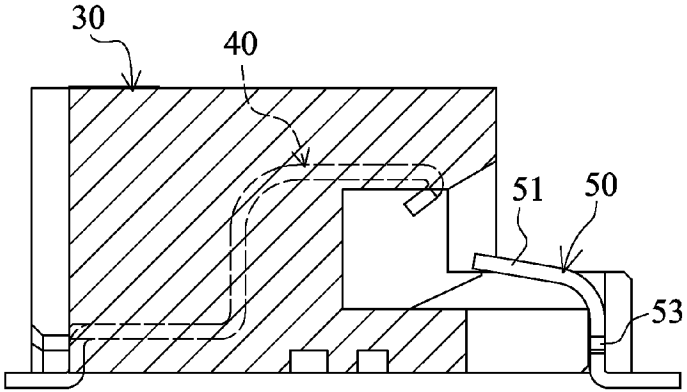
FIG. 35 is a cross-sectional side view showing a fourteenth embodiment of the invention.

As shown in FIG. 35, the fourteenth embodiment of the invention is almost the same as the thirteenth embodiment except for the difference that the second terminal 50 of this embodiment is assembled to the plastic base 30 from bottom to top.

Figure 36:
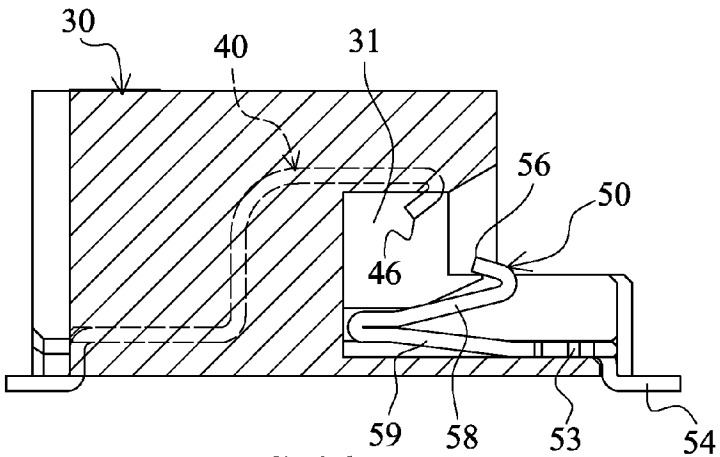
FIG. 36 is a cross-sectional side view showing a fifteenth embodiment of the invention.

As shown in FIG. 36, the fifteenth embodiment of the invention is almost the same as the fifth embodiment except for the difference that the fixing portion 53 of the second terminal 50 of this embodiment extends horizontally backwards, and has a first elastic arm 58 and a second elastic arm 59. The second elastic arm 59 is connected to the fixing portion 53 and extends backwards and slightly upwards. The first elastic arm 58 is bent frontwards from the second elastic arm 59 and extends upwards, and the rear section is bent upwards and extends backwards. The pin 54 horizontally extends out of the front end of the plastic base 30.

Figure 37:
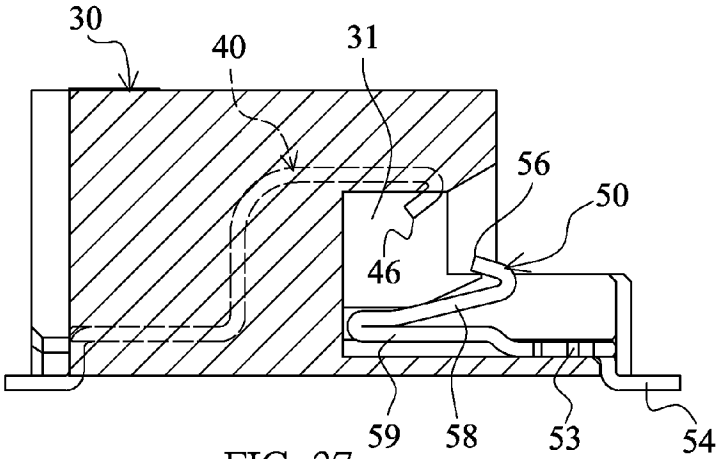
FIG. 37 is a cross-sectional side view showing a sixteenth embodiment of the invention.
Figure 38:
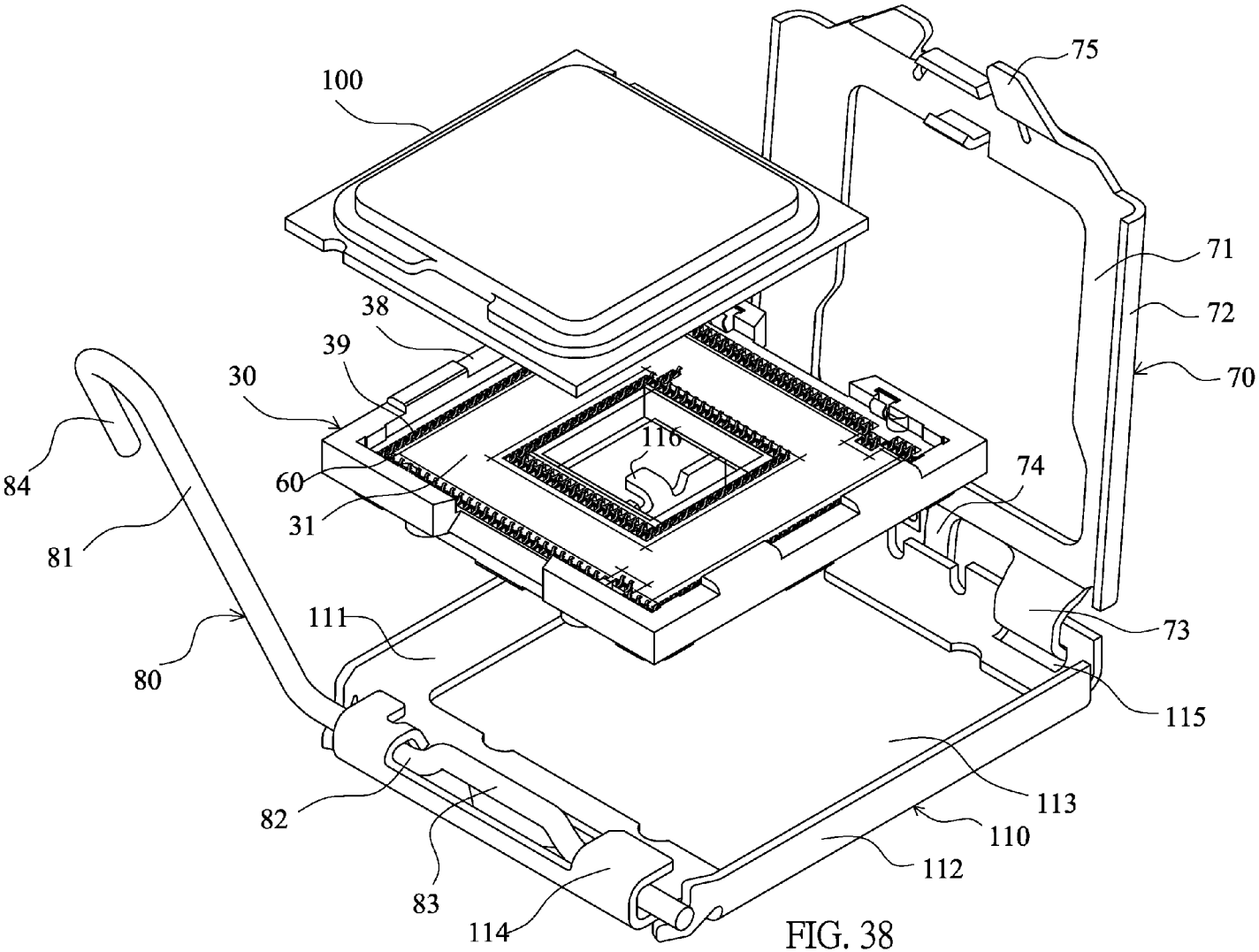
FIG. 38 is a pictorially exploded view showing a seventeenth embodiment of the invention.
Figure 39:
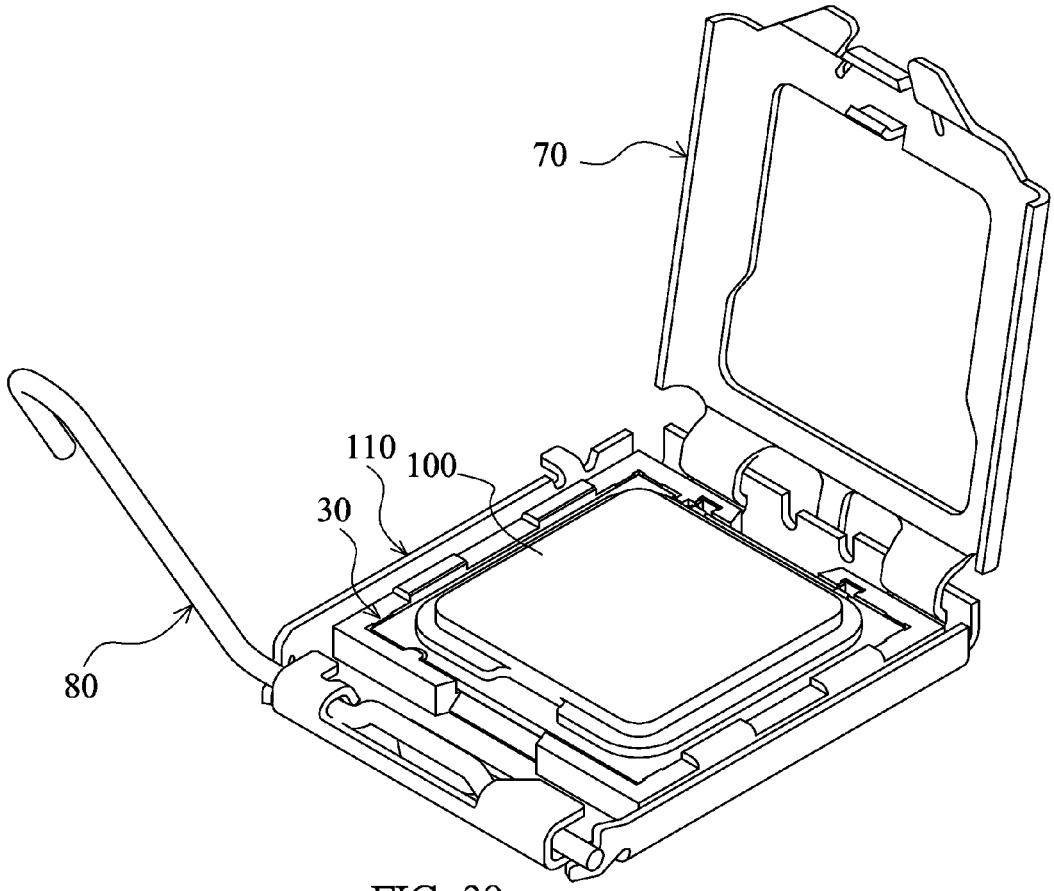
FIG. 39 is a pictorially assembled view showing the seventeenth embodiment of the invention.
Figure 40:
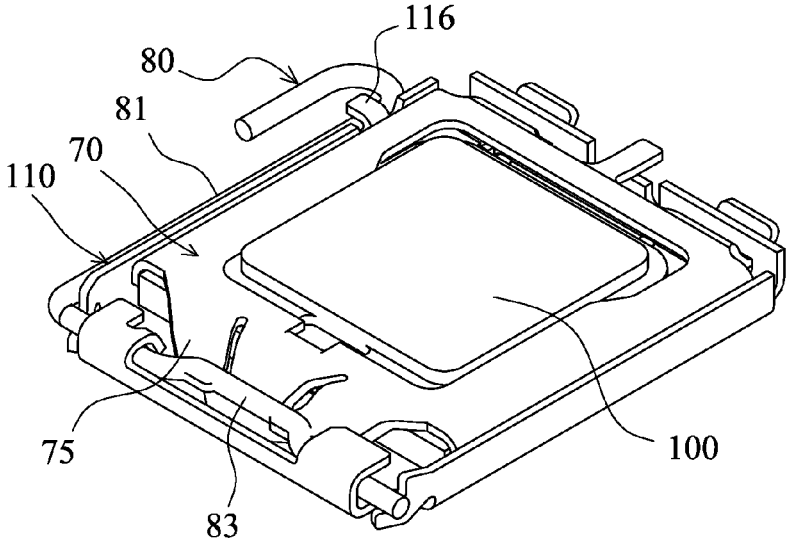
FIG. 40 is a pictorial view showing the usage state of the seventeenth embodiment of the invention.
Figure 41:
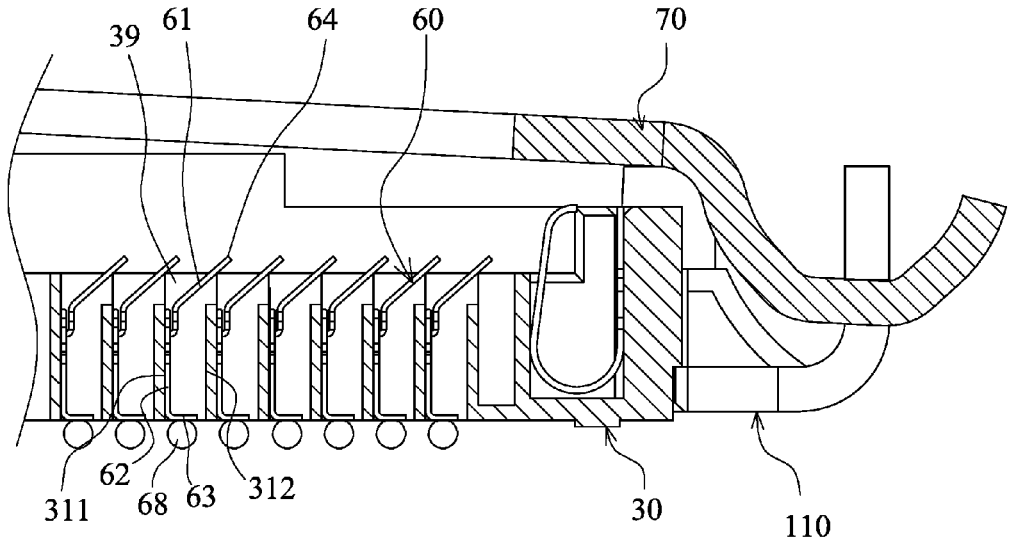
FIG. 41 is a cross-sectional side view showing the seventeenth embodiment of the invention.

As shown in FIG. 37, the sixteenth embodiment of the invention is almost the same as the fifteenth embodiment except for the difference that the second elastic arm 59 of this embodiment is bent upwards by a height and then extends horizontally backwards.

As shown in FIGS. 38 to 42, the seventeenth embodiment of the invention is a CPU electrical connector including a plastic base 30, an external seat 110, multiple rows of terminals 60, an upper cover 70 and a lever 80.

The external seat 110 is made of a metal material and has a bottom surface 111 and two sidewalls 112. The middle of the bottom surface 111 is formed with an opening 113. In addition, the front end of the external seat has a first pivot portion 114, the rear end of the first pivot portion 114 has a second pivot portion 115 in the form of a hole, and one side of the external seat has an engaging sheet 116.

Figure 43:
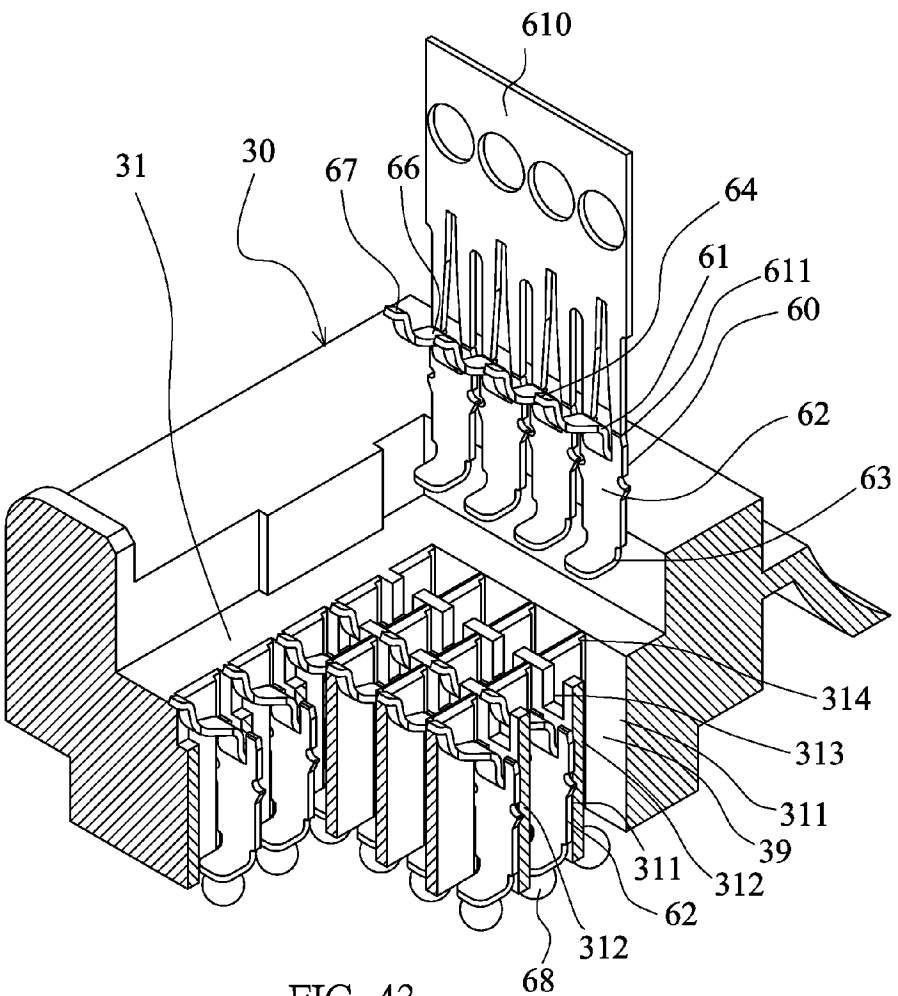
FIG. 43 is a pictorial view showing terminals and an inner seat according to the seventeenth embodiment of the invention.

The plastic base 30 is accommodated within the external seat 110. Multiple rows of matrix-arranged terminal slots 39 are formed on the plastic base. The periphery of the top end of the plastic base has an upward flange 38 to enclose a connection slot 31 for accommodating a chip (an electrical device) 100. As shown in FIG. 43, each terminal slot 39 has opposite first and second walls 311 and 312. Two sides of the first wall have slots 314. The upper edge of the second wall 312 has a notch 313 connected to the neighboring terminal slot 39.

The multiple rows of terminals 60 are assembled, from top to bottom, to the multiple rows of terminal slots 39 of the plastic base 30. The terminal 60 is formed by bending the plate surface of the metal sheet and has a fixing portion 62, an elastic arm 61 and a pin 63. The fixing portion 62 rests against the first wall 311 of the terminal slot 39 and engages with the slot 314. The elastic arm 61 has one end connected to the top end of the fixing portion 62, the other end extending slantingly upwards, a lower section 66 being an inclined wide plate, and an upper section 67 being an inclined narrow plate. The upper section 67 extends to the neighboring terminal slot 39 and vertically corresponds to the lower section 66 of the terminal 60 in the terminal slot 39. One edge connected between the distal-end cut surface of the elastic arm 61 and the plate surface of the elastic arm is a tip point, which is a connection point 64 projecting mostly upwards. The connection point 64 projects from the terminal slot 39 to the connection slot 31. The pin 63 has one end connected to the bottom end of the fixing portion 62 and the other end bent to form a horizontal sheet to bond a solder ball 68. After multiple rows of terminals 60 are assembled into the plastic base 30, the solder ball 68 is bonded to the pin 63 of each terminal.

The width of the notch 314 of the terminal slot 39 is only slightly larger than the width of the upper section 66 of the elastic arm 61 of the terminal 60, so that the elastic arm 61 of the terminal only can elastically and vertically move and can be restricted by the notch 314 without left and right offsets. In addition, as shown in FIG. 43, after the terminals are manufactured, they are separately arranged according to the pitch of the terminal slot 39 and are connected to a material tape 610 to form continuous terminals. The top end of the fixing portion 61 is connected to the material tape 610 and is formed with a breaking mark 611. The whole row of terminals 60 are assembled into one row of terminal slots 39 at a time and then the material tape 610 is broken from the breaking mark 611.

The upper cover 70 has a cover surface 71 and two sidewalls 72. Each of two sides of the rear end of the upper cover is formed with an arced pivot portion 73. The middle of the rear end of the upper cover is formed with a stopping sheet 74. The pivot portion 73 is pivotally connected to the second pivot portion 95 of the rear end of the external seat 110. The front end of the upper cover has two tabs 75 transversally projecting frontwards. When the upper cover 70 covers the plastic base 30, the cover surface 71 can press down the periphery of the chip 100. In addition, when the upper cover 70 is lifted to be longitudinal, the stopping sheet 74 can rest against the rear end of the external seat 110 without falling out.

The lever 80 has a first rod 81 and a second rod 82 perpendicular to each other. The second rod 82 is pivotally connected to the first pivot portion 114 of the front end of the external seat 110 of the base, and is curved to form a projecting rod 83. The outer end of the first rod 81 is curved to form a handle 84. When the first rod 81 is swung toward the rear end of the base, the projecting rod 83 can press the tab 75 of the upper cover 70 to make the upper cover 70 press down the chip 90 to be electrically connected to the multiple rows of terminals 60. As shown in FIG. 7, when the lever 80 is swung to the predetermined position, its first rod 81 can engage under the engaging sheet 116 of the external seat 110.

Figure 42:
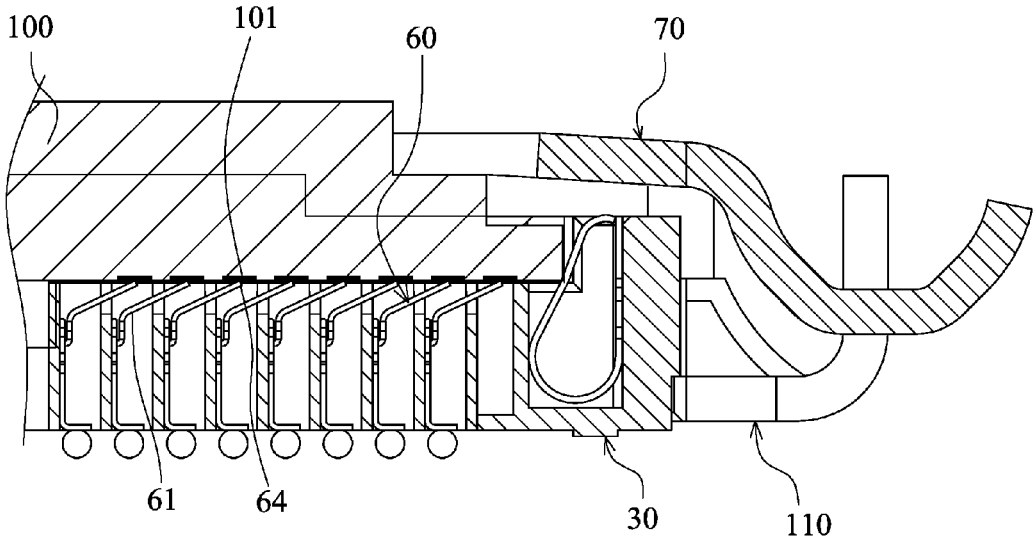
FIG. 42 is a cross-sectional side view showing the usage state of the seventeenth embodiment of the invention.

According to the above-mentioned structure, since the elastic arm 61 extends to the neighboring terminal slot 41, the elastic arm 61 may have the excellent elasticity, and the connection point 64 is the distal-end cut surface of the elastic arm. As shown in FIG. 42, when the chip 100 is pressed by the upper cover 70 to contact with the terminal, the elastic arm 61 of the terminal elastically retracts, and the connection point 64 may elastically contact with the connection point 101 of the chip 100, and the better effects of scratching can be obtained according to the contact with the cut surface, so that the oxide layer of the connection point 101 can be effectively scratched.

Figure 44:
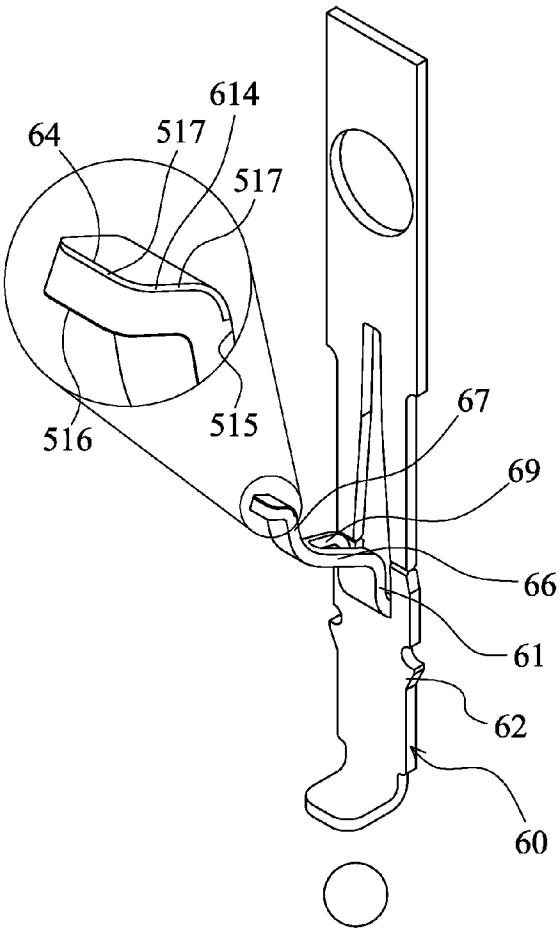
FIG. 44 is a pictorial view showing a terminal according to an eighteenth embodiment of the invention.
Figure 45:
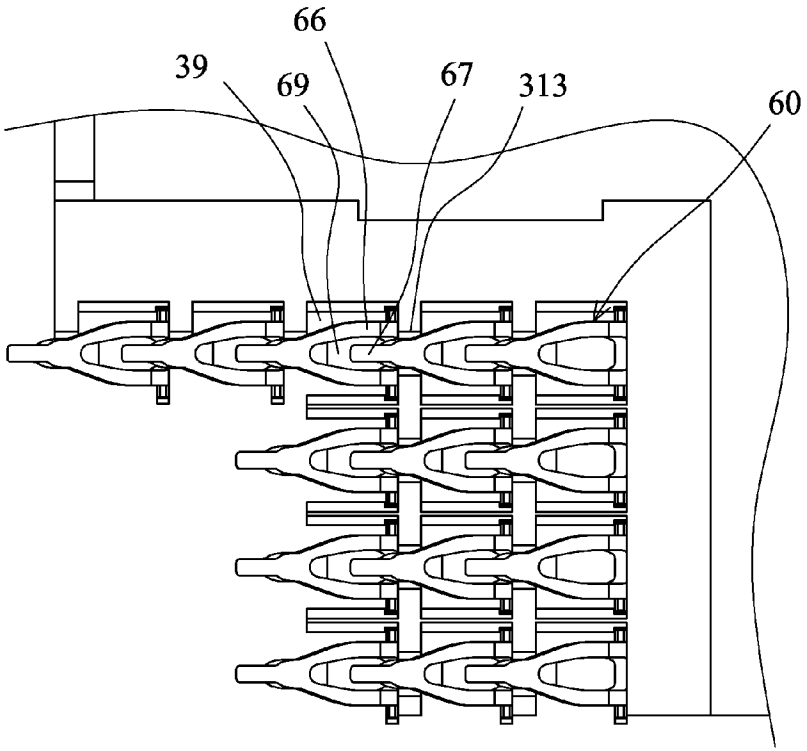
FIG. 45 is a top view showing the terminals and an inner seat according to the eighteenth embodiment of the invention.

As shown in FIGS. 44 and 45, the eighteenth embodiment of the invention is almost the same as the seventeenth embodiment except for the difference that a wide plate 66 of the lower section of the elastic arm 61 of the terminal 60 has an opening 69. A narrow plate 67 of the upper section of the elastic arm 61 extends to the neighboring terminal slot and vertically corresponds to the opening 69 of the wide plate 66 of the terminal in the terminal slot and can step aside without contacting with the wide plate 66 having the opening 69. Thus, even if the height difference between the upper and lower sections of the elastic arm 61 is improperly controlled, the front and rear terminals 60 may also step aside through the opening 68 without contacting with each other to cause the short-circuited condition.

In the elastic arm 61 of this embodiment, the punching forming direction causes one edge of the connection point 64 to become the burr 515 and the other edge to become the natural R-corner 516. In this case, the burr of the connection point 64 has to be removed to form the chamfer 517, and the burrs on the two sides 614 of the rear section of the elastic arm of the connection point 64 also have to be removed to form the chamfer 517.

Figure 46:
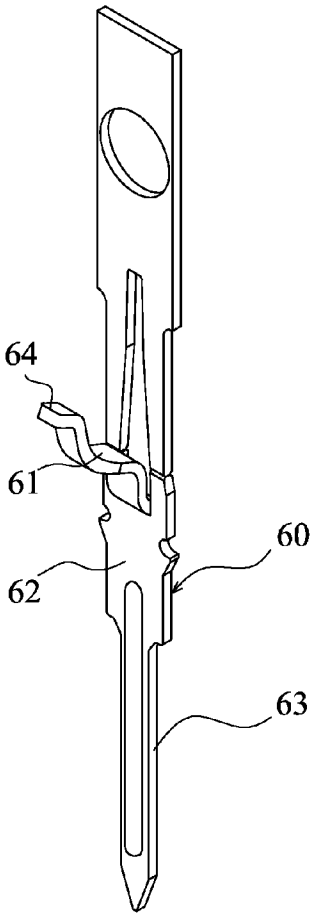
FIG. 46 is a pictorial view showing a terminal according to a nineteenth embodiment of the invention.

As shown in FIG. 46, the nineteenth embodiment of the invention is almost the same as the seventeenth embodiment except for the difference that the pin 63 of the terminal 60 extends longitudinally.

Figure 48:
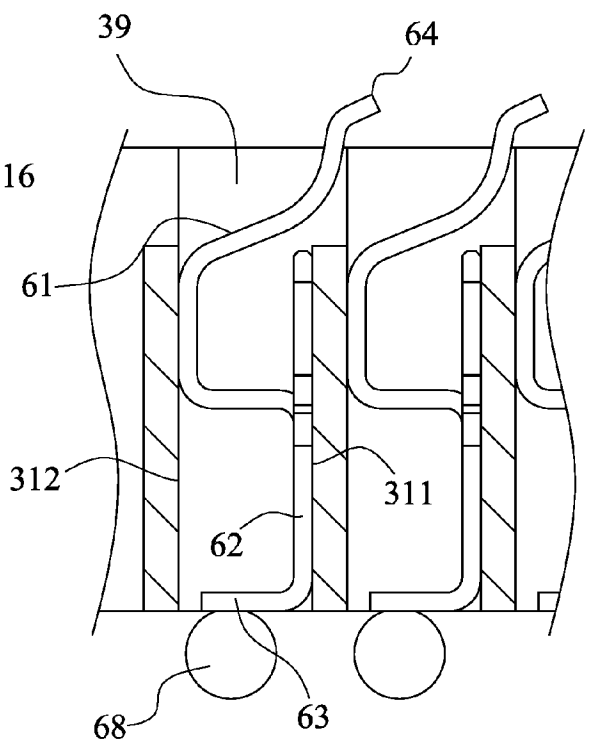
FIG. 48 is a cross-sectional side view showing the $20^{th}$ embodiment of the invention.
Figure 47:
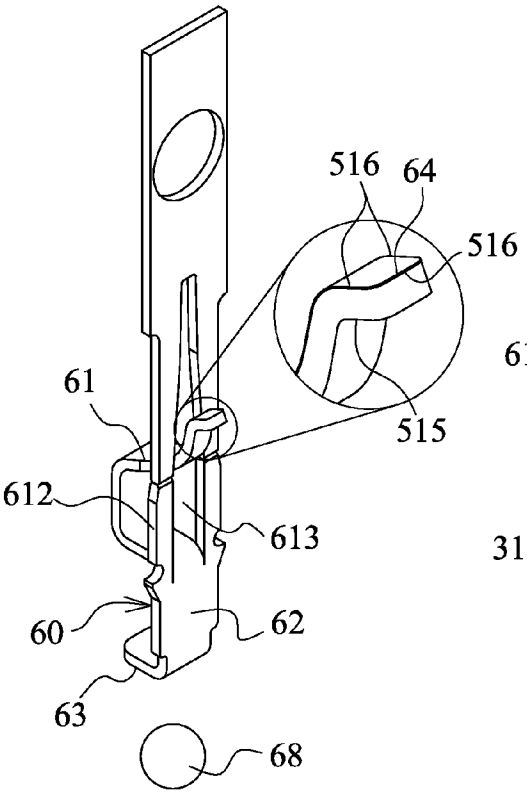
FIG. 47 is a pictorial view showing a terminal according to a $20^{th}$ embodiment of the invention.

As shown in FIGS. 47 and 48, the 20$^{th}$ embodiment of the invention is almost the same as the seventeenth embodiment, wherein the tip point of the edge corner of the distal-end cut surface of the elastic arm 61 of the terminal 60 is the most upwardly projecting connection point 64, except for the difference that the elastic arm 61 of the terminal 60 firstly extends near the second wall 312 and then turns back to make the distal end pass through the first wall 311 to the position above the neighboring terminal slot. In this way, the elasticity of the elastic arm can be increased, and the positioning stability of the terminal in the terminal slot may also be enhanced. In addition, the top end of the fixing portion 62 has two lateral sides 612, and the middle of the fixing portion 62 is formed with a notch 613. The rear section of the elastic arm 61 of the terminal penetrates through the notch 613, so that the two lateral sides 612 can restrict the left and right moving directions of the elastic arm 61.

In the elastic arm 61 of this embodiment, the punching forming direction causes one edge of the connection point 64 to become the natural R-corner 516 and the other edge to become the burr 515. In this case, the connection point 64 and the two sides of the rear section of the elastic arm of the connection point 64 are natural R-corners with the good contact property, and need not to be chamfered.

Figure 49:
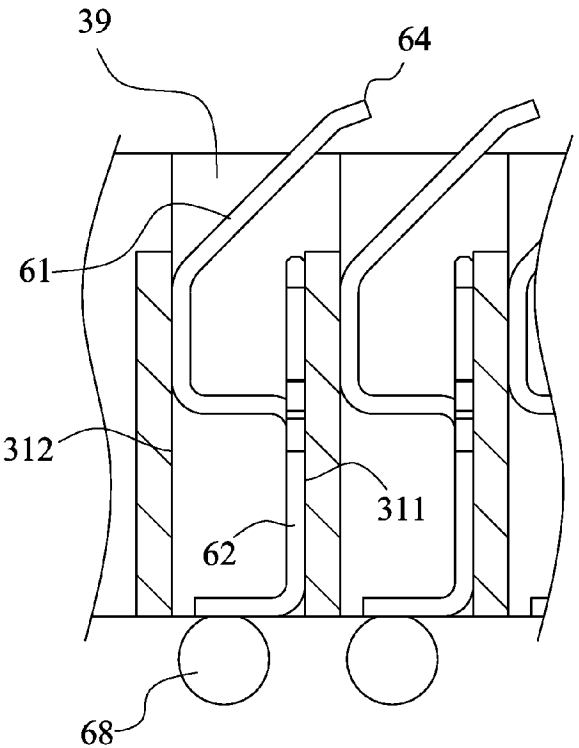
FIG. 49 is a cross-sectional side view showing a $21^{st}$ embodiment of the invention.

As shown in FIG. 49, the 21$^{st}$ embodiment of the invention is almost the same as the 20$^{th}$ embodiment except for the difference that the rear section of the elastic arm 61 of the terminal 60 extends in a different curvature.

Figure 51:
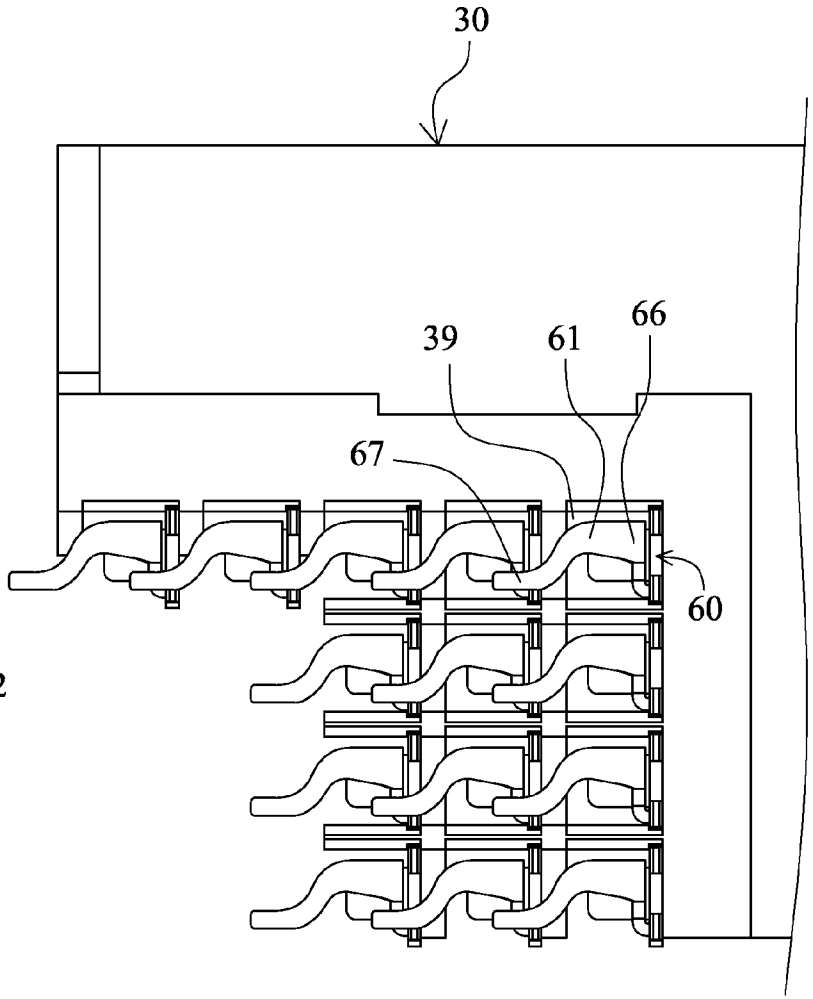
FIG. 51 is a top view showing the terminals and an inner seat according to the $22^{nd}$ embodiment of the invention.
Figure 50:
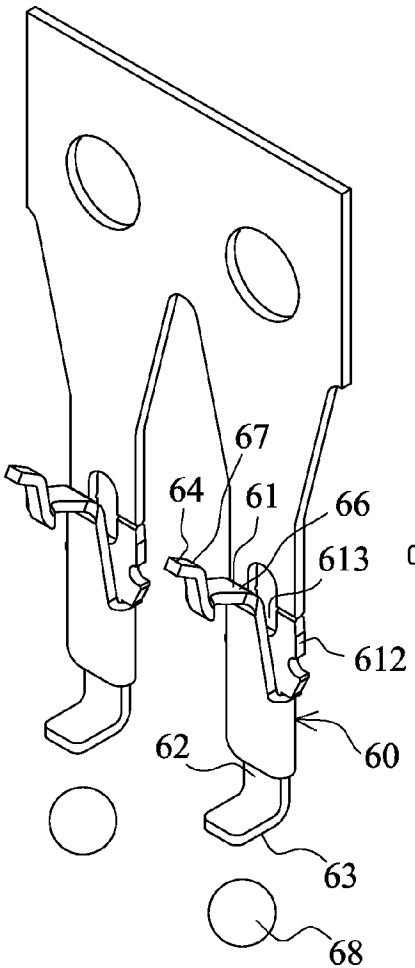
FIG. 50 is a pictorial view showing a terminal according to a $22^{nd}$ embodiment of the invention.

As shown in FIGS. 50 and 51, the 22$^{nd}$ embodiment of the invention is almost the same as the seventeenth embodiment, wherein the tip point of the edge corner of the distal-end cut surface of the elastic arm 61 of the terminal 60 is similarly the most upwardly projecting connection point 64, except for the difference that the elastic arm 61 of the terminal 60 of this embodiment is connected to one side of the fixing portion 62, and the lower section 66 and the upper section 67 of the elastic arm are staggered.

Figure 52:
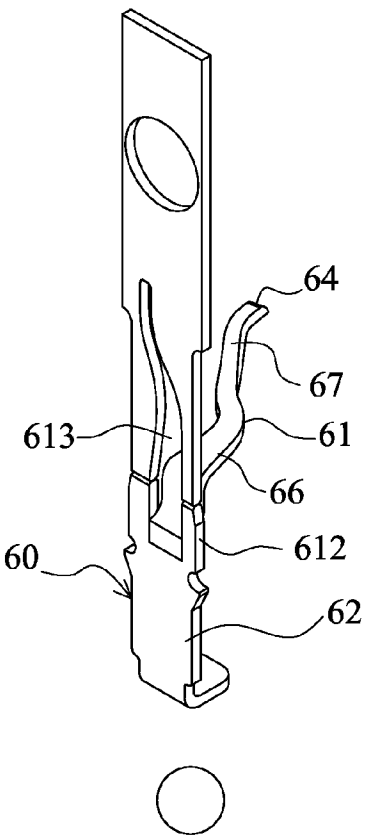
FIG. 52 is a pictorial view showing a terminal according to a $23^{rd}$ embodiment of the invention.

As shown in FIG. 52, the 23$^{rd}$ embodiment of the invention is almost the same as the 22$^{nd}$ embodiment, wherein the lower section 66 and the upper section 67 of the elastic arm 61 of the terminal 60 are similarly staggered, except for the difference that the elastic arm 61 of the terminal 60 of this embodiment is connected to the top end of the fixing portion 62, and the distal-end cut surface of the elastic arm is cut into a circular arc surface and is the most upwardly projecting connection point 64.

Figure 53:
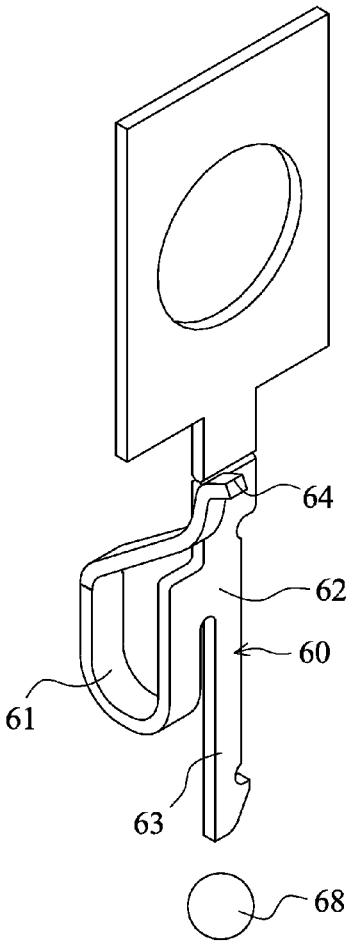
FIG. 53 is a pictorial view showing a terminal according to a $24^{th}$ embodiment of the invention.

As shown in FIG. 53, the 24$^{th}$ embodiment of the invention is almost the same as the seventeenth embodiment except for the difference that the elastic arm 61 of the terminal 60 of this embodiment is curved into the U shape.

Figure 54:
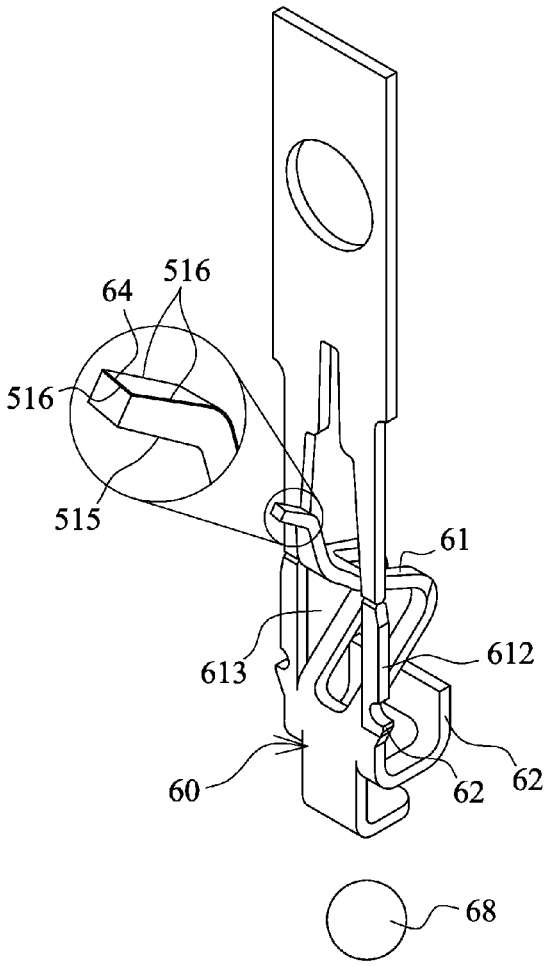
FIG. 54 is a pictorial view showing a terminal according to a $25^{th}$ embodiment of the invention.

As shown in FIG. 54, the 25$^{th}$ embodiment of the invention is almost the same as the 20$^{th}$ embodiment except for the difference that the bending angle of the elastic arm 61 of the terminal 60 is slightly different from that of the 20$^{th}$ embodiment, and the fixing portion 62 is bent into the U shape.

In the elastic arm 61 of this embodiment, the punching forming direction causes one edge of the connection point 64 to become the natural R-corner 516 and the other edge to become the burr 515. In this case, the connection point 64 and the two sides of the rear section of the elastic arm of the connection point 64 are natural R-corners with the good contact property, and need not to be chamfered.

Figure 55:
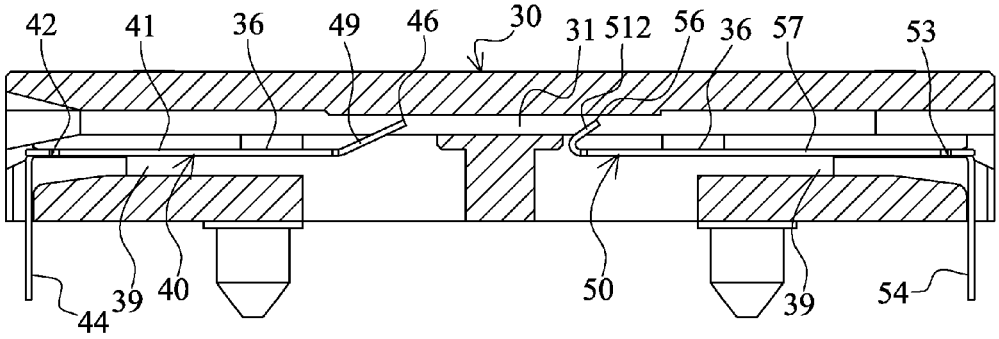
FIG. 55 is a cross-sectional side view showing a $26^{th}$ embodiment of the invention.

As shown in FIG. 55, the 26$^{th}$ embodiment of the invention is another electrical connector including a plastic base 30, one row of first terminals 40 and one row of second terminals 50.

The plastic base 30 has a connection slot 31 with an opening facing frontwards, and two rows of terminal slots 39. An electrical element may be inserted into the connection slot 31. The top end of the terminal slot 39 has a transversally resting standard plane 36.

The first terminal 40 has an elastic arm 41, a fixing portion 42 and a pin 44. The fixing portion 42 is horizontally fixed to the plastic base 30. The fixing portion 42 and the elastic arm 41 extend horizontally away from the opening of the connection slot 31. The rear section of the elastic arm 41 has the contact section 49 with the narrower plate surface. The contact section 49 is bent upwards and projects to the connection slot 31. The front section of the elastic arm 41 rests against the transversally resting standard plane 36. The distal-end cut surface of the contact section 49 of the elastic arm 41 is the most upwardly projecting connection point 46. The pin 44 longitudinally extends out of the bottom surface of the front end of the plastic base 30.

The second terminal 50 has an elastic arm 57, a fixing portion 53 and a pin 54. The fixing portion 53 is horizontally fixed to the plastic base 30. The fixing portion 53 and the elastic arm 57 horizontally extend to the opening of the connection slot. The rear section of the elastic arm 57 is bent to form a contact section 512, which has the narrower plate surface and extends backwards and upwards. The distal-end cut surface of the contact section 512 of the elastic arm 57 is the most upwardly projecting connection point 56. The front section of the elastic arm 41 rests against the transversally resting standard plane 36. The connection point 56 projects to the connection slot 31. The connection points 46 and 56 of the first and second terminals 40 and 50 are disposed in a front-to-rear direction and face upwards.

Figure 56:
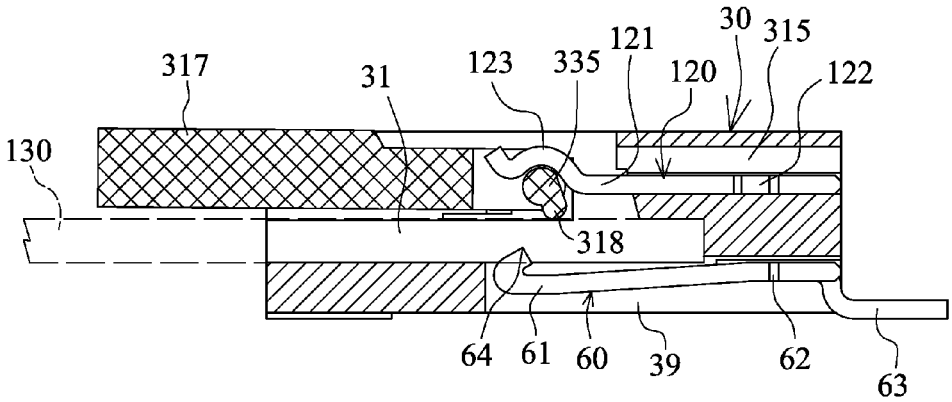
FIG. 56 is a cross-sectional side view showing a cover, which is rotated to be horizontal, according to a $27^{th}$ embodiment of the invention.
Figure 57:
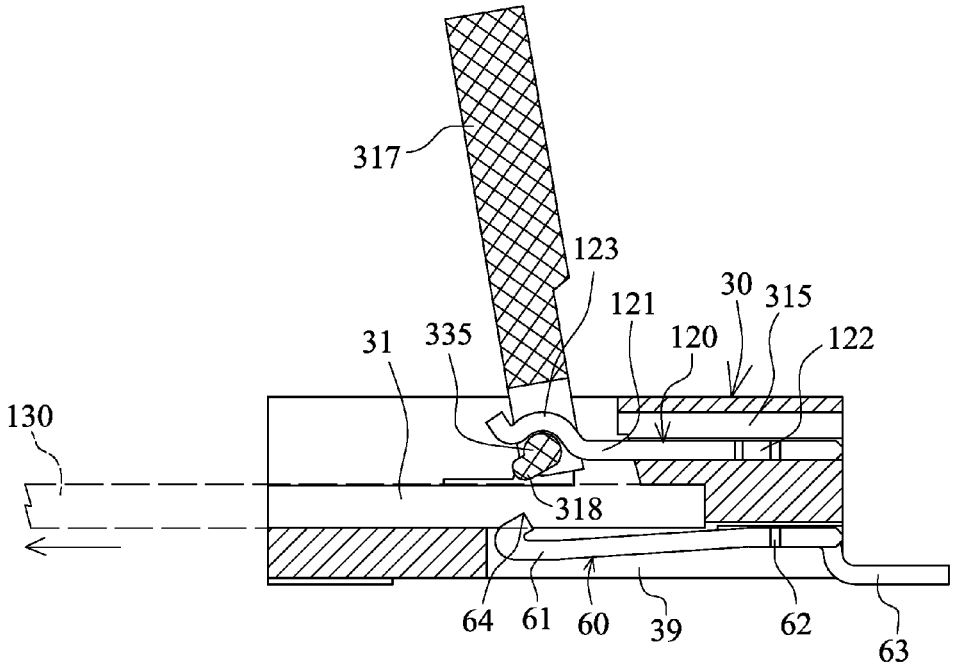
FIG. 57 is a cross-sectional side view showing the cover, which is lifted up, according to the $27^{th}$ embodiment of the invention.

As shown in FIGS. 56 and 57, the 27$^{th}$ embodiment of the invention is a cable connector including a plastic base 30, one row of terminals 60 and one row of elastic pressing sheets 120.

The plastic base 30 has a connection slot 31 with an opening facing frontwards and is pivotally connected to a cover 317. A cable 130 may be inserted into the connection slot 31. The cable has one row of connection points. One row of elastic pressing sheet slots 315 are disposed above the connection slot 31 and one row of terminal slots 39 are disposed below the connection slot 31. The cover 317 has a pivot portion 335 and a cam 318. When the cover 317 is pivotally rotated, the cam 318 may tightly press against or be released from the cable 130.

The one row of terminals 60 are disposed in the one row of terminal slots 39 of the plastic base 30. Each terminal 60 is formed by bending the plate surface of the metal sheet, and sequentially has, from one end to the other end, an elastic arm 61, a fixing portion 62 and a pin 63. The fixing portion 62 extends horizontally frontwards and is fixed to the plastic base 30. The elastic arm 61 extends to the opening of the connection slot 31 and has a rear section bent upwards away from the opening of the connection slot 31. The bent portion of the elastic arm 41 has no elasticity and has a most upwardly projecting connection point 64. The connection point 64 is one edge connected between the distal-end cut surface of the elastic arm 61 and the plate surface of the elastic arm, and is a tip point projecting toward the connection slot 31. When the cable (electrical device) 130 is placed into the connection slot 31 and electrically connected to the connection point 64, the connection point 64 is directly pressed by the electrical device to make the elastic arm 61 elastically move in the plate surface direction (the direction perpendicular to the plate surface). The connection point 64 is electrically connected to the connection point of the cable 130, and the pin 63 extends from the rear end of the plastic base 30.

The one row of elastic pressing sheets 120 is disposed in one row of elastic pressing sheet slots 315 of the plastic base. Each elastic pressing sheet 120 is formed by bending the plate surface of the metal sheet and has an elastic arm 121 and a fixing portion 122. The fixing portion 122 extends horizontally frontwards and is fixed to the plastic base. The elastic arm 122 extends to the opening of the connection slot 31 and has a pivot portion 123 pivotally connected to and elastically pressing the pivot portion 335 of the cover 317. The cam 318 of the cover 317 may tightly press against the cable 130. The elastic arms 61 of one row of terminals 60 and the elastic arms 121 of one row of elastic pressing sheets 120 respectively tightly press against the top and bottom surfaces of the cable 130. The elastic arms 61 of the one row of terminals 60 and the elastic arms 121 of the one row of elastic pressing sheets 120 elastically move in the plate surface direction when being pressed by the cable 130.

The connection point 64 of the terminal 60 of this embodiment is the natural R-corner or burrless chamfer formed during punching. In addition, the two sides of the rear section of the elastic arm connected to the connection point 64 are also the natural R-corners or burrless chamfers formed during punching. Thus, the poor contact, caused by the rugged burr, cannot occur during the electrical connection.

The one row of terminals 60 and the one row of elastic pressing sheets 120 of this embodiment are formed by bending and pressing the plate surface, are different from the conventional C-shaped terminal formed by punching the plate, and may be pressed into continuous terminals to save the manufacturing cost.

Figure 58:
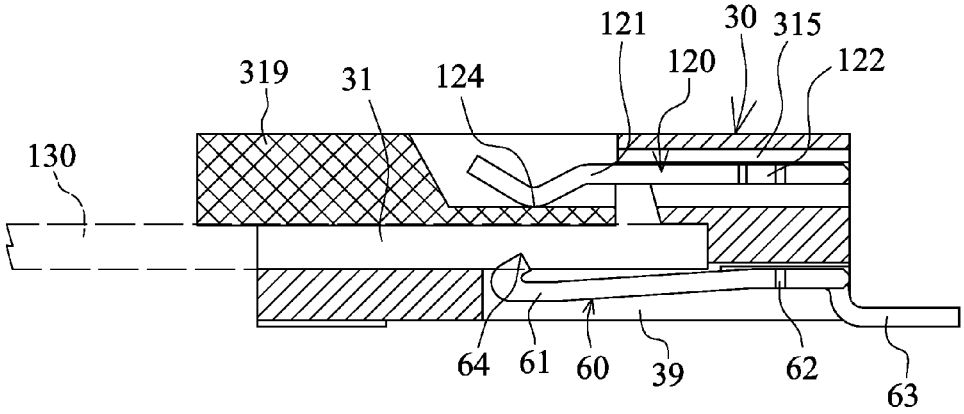
FIG. 58 is a cross-sectional side view showing a sliding sheet, which is inserted into the connection slot, according to a $28^{th}$ embodiment of the invention.
Figure 59:
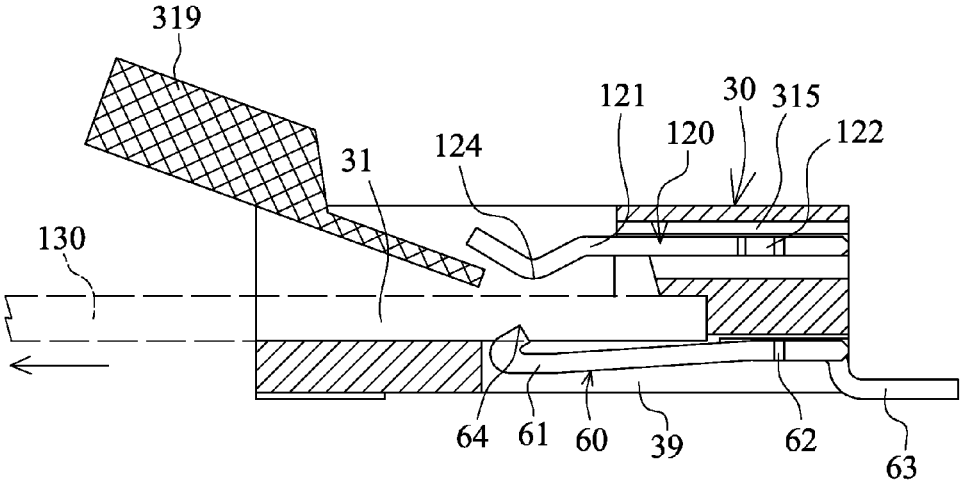
FIG. 59 is a cross-sectional side view showing the sliding sheet, which slides out of the connection slot, according to the $28^{th}$ embodiment of the invention.

As shown in FIGS. 58 and 59, the 28$^{th}$ embodiment of the invention is a cable connector including a plastic base 30, one row of terminals 60 and one row of elastic pressing sheets 120, and is almost the same as the 27$^{th}$ embodiment except for the difference that the plastic base 30 of this embodiment has a sliding sheet 319, which may slide into the connection slot 31. Each elastic arm 121 of the one row of elastic pressing sheets 120 has a projection 124, which projects toward the connection slot 31 and presses the sliding sheet 319 to indirectly tightly press against the cable 130.

Figure 60:
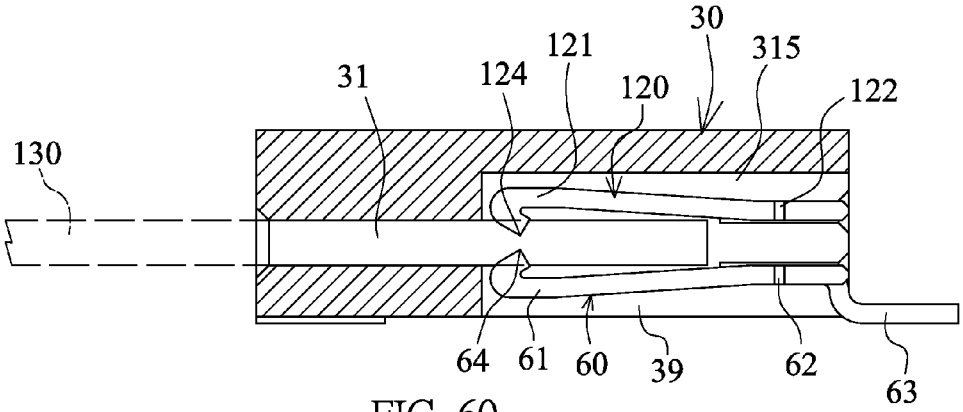
FIG. 60 is a cross-sectional side view showing a 29$^{th}$ embodiment of the invention.

As shown in FIG. 60, the 29$^{th}$ embodiment of the invention is a cable connector including a plastic base 30, one row of terminals 60 and one row of elastic pressing sheets 120, and is almost the same as the 27$^{th}$ embodiment, except for the difference that the plastic base 30 of this embodiment has no cover or sliding sheet. The rear section of the elastic arm 121 of each of the one row of elastic pressing sheets 120 is bent downwards to form a projection 124, which projects towards the connection slot 31 and directly tightly presses against the cable 130.

Figure 61:
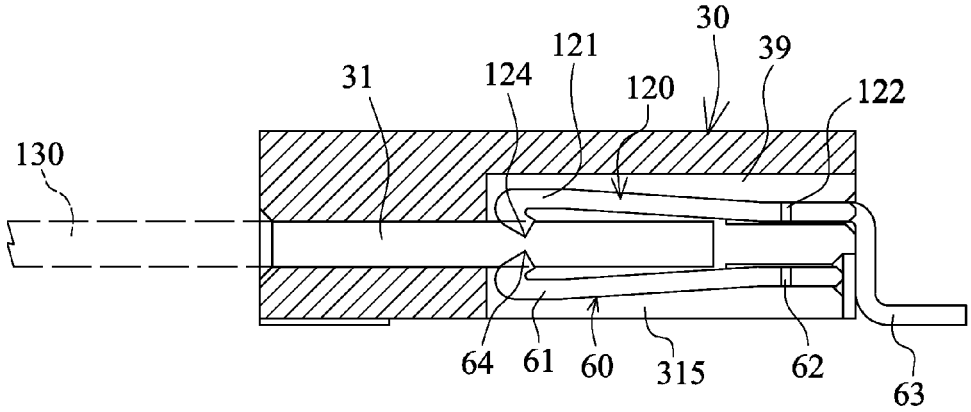
FIG. 61 is a cross-sectional side view showing a 30$^{th}$ embodiment of the invention.

As shown in FIG. 61, the 30$^{th}$ embodiment of the invention is a cable connector, which is almost the same as the 29$^{th}$ embodiment except for the difference that the one row of elastic pressing sheet slots 315 of this embodiment are disposed below the connection slot 31, the one row of terminal slots 39 are disposed above the connection slot 31, the rear section of the elastic arm 61 of each of the one row of terminals 60 is bent downwards away from the opening of the connection slot 31. The bent portion of the elastic arm 41 has no elasticity and has the most downwardly projecting connection point 64. The rear section of the elastic arm 121 of each of the one row of elastic pressing sheets 120 is bent upwards to form a projection 124, which projects toward the connection slot 31 and directly tightly presses against the cable 130.

Figure 62:
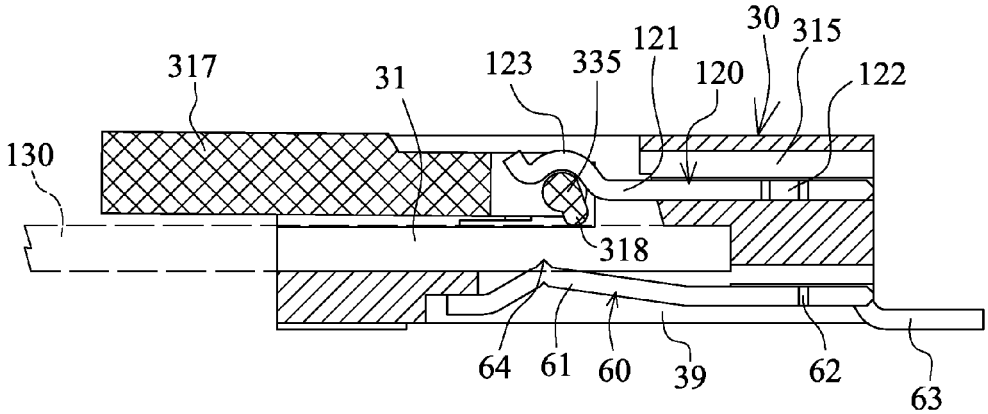
FIG. 62 is a cross-sectional side view showing a 31$^{st}$ embodiment of the invention.

As shown in FIG. 62, the 31$^{st}$ embodiment of the invention is a cable connector including a plastic base 30, one row of terminals 60 and one row of elastic pressing sheets 120, and is almost the same as the 27$^{th}$ embodiment except for the difference that the connection point 64 of the terminal 60 of this embodiment is formed by bending the plate surface of the elastic arm 61 to project upwards. The distal end of the elastic arm 61 rests against the plastic base 30. The connection point 64 projects to the connection slot 31 and is the R-corner, which is in the form of the tip point and is formed by pressing the plate surface of the elastic arm 61, so that the better scratching effect can be obtained.

Figure 63:
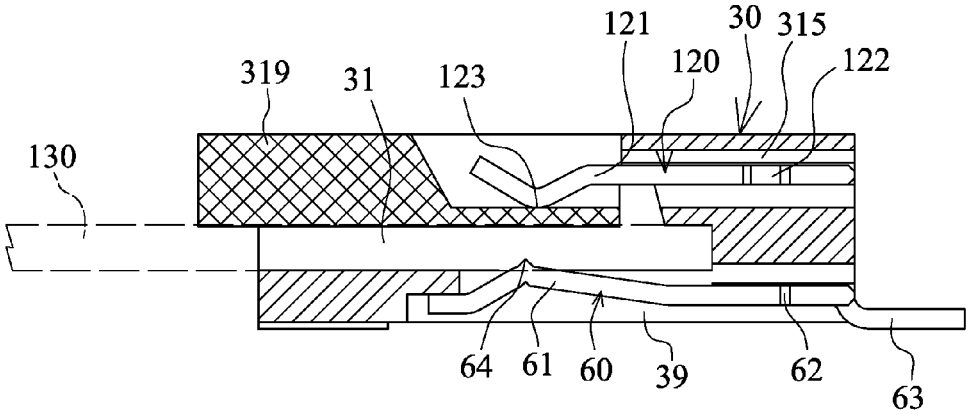
FIG. 63 is a cross-sectional side view showing a 32$^{nd}$ embodiment of the invention.

As shown in FIG. 63, the 32$^{nd}$ embodiment of the invention is a cable connector including a plastic base 30, one row of terminals 60 and one row of elastic pressing sheets 120, and is almost the same as the 28$^{th}$ embodiment except for the difference that the connection point 64 of the terminal 60 of this embodiment is formed by bending the plate surface of the elastic arm 61 to project upwards. The distal end of the elastic arm 61 rests against the plastic base 30. The connection point 64 projects toward the connection slot 31 and the plate surface of the elastic arm 61 is pressed to form the smaller R-corner and is in the form of the tip point, so that the better scratching effect can be obtained.

Figure 64:
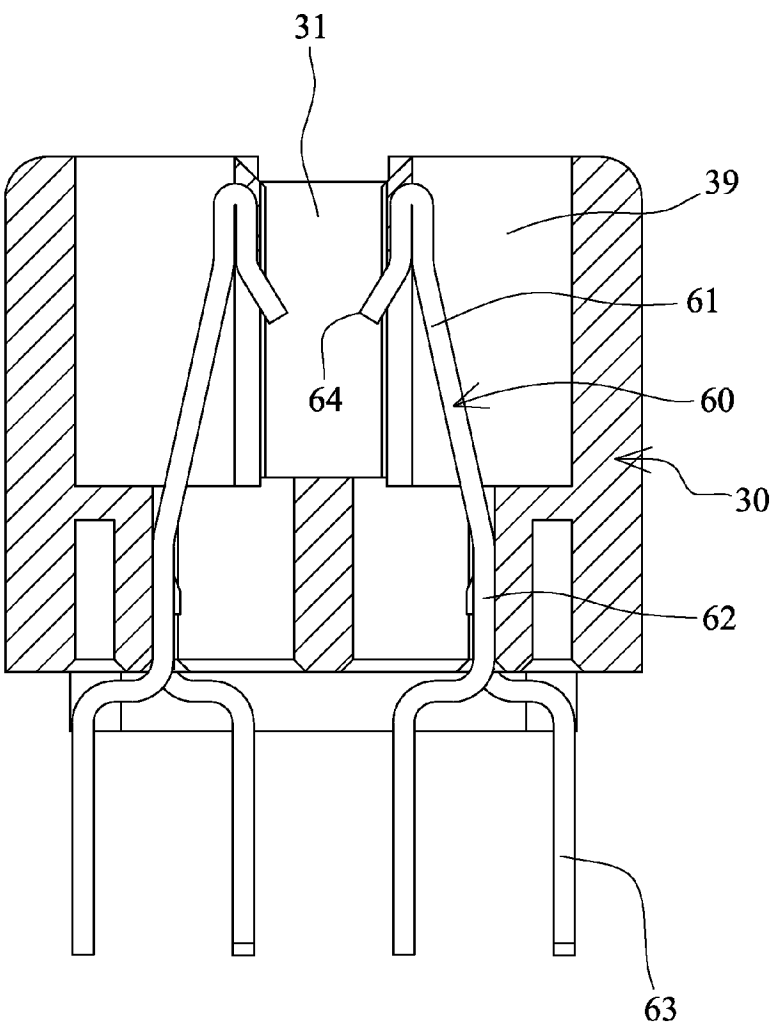
FIG. 64 is a cross-sectional side view showing a 33$^{rd}$ embodiment of the invention.
Figure 66:
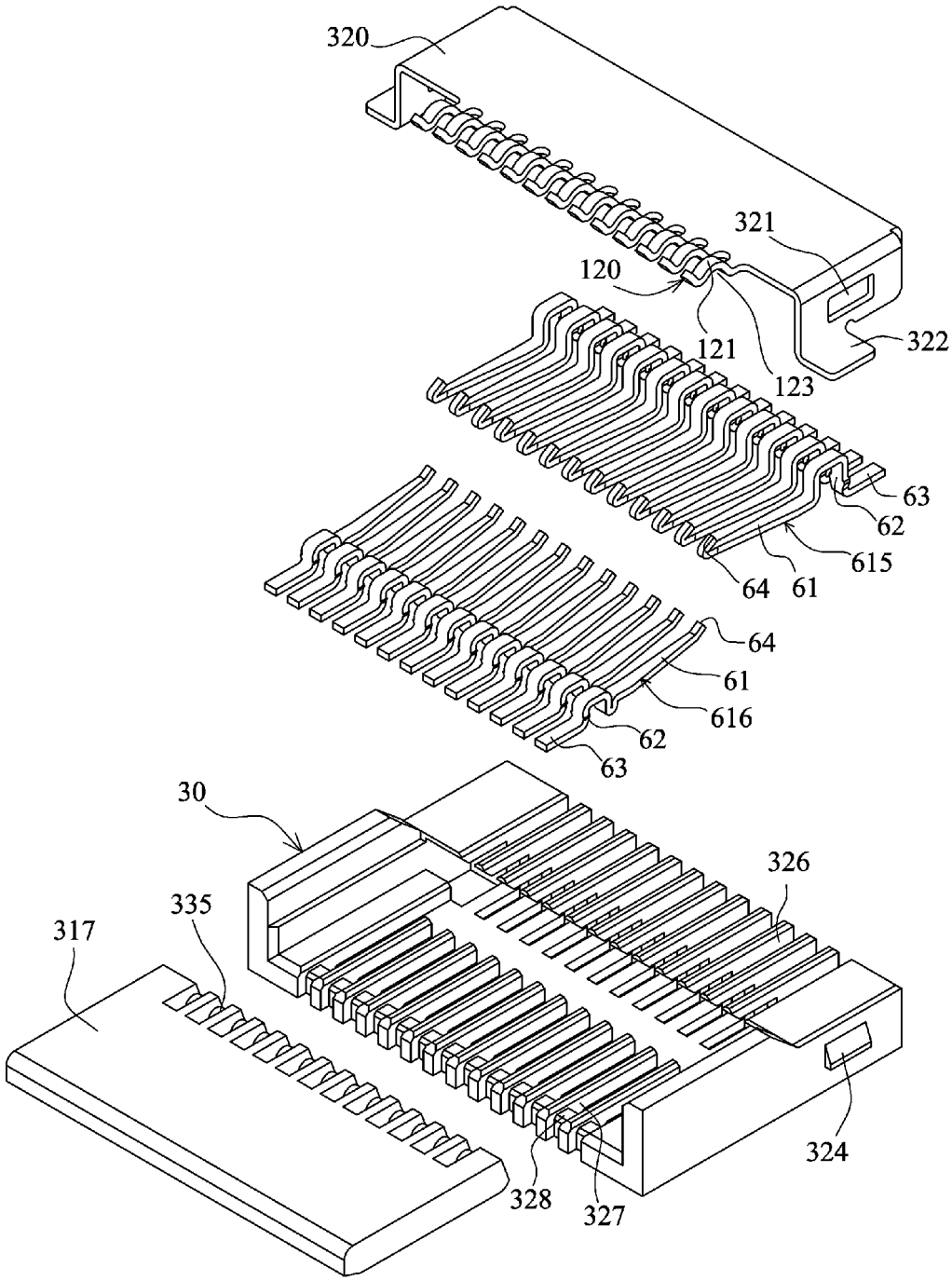
FIG. 66 is a pictorially exploded view showing a 35$^{th}$ embodiment of the invention.
Figure 67:
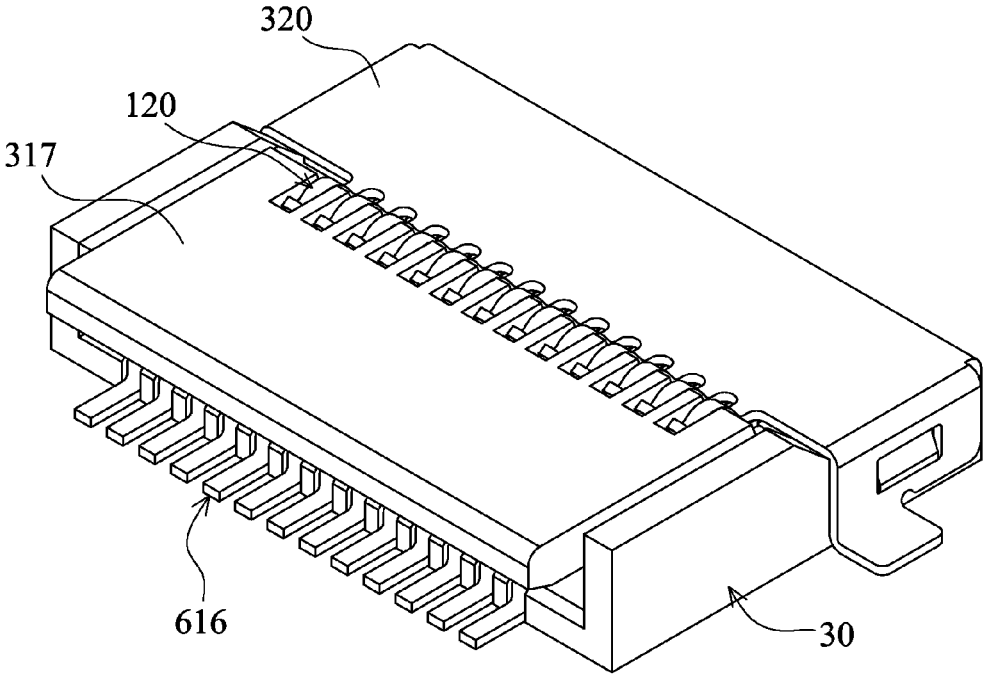
FIG. 67 is a pictorially assembled view showing the 35$^{th}$ embodiment of the invention.
Figure 68:
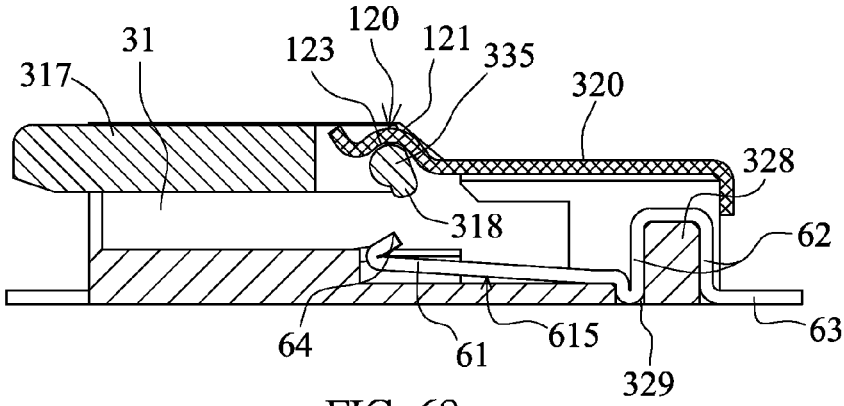
FIG. 68 is a cross-sectional side view showing the 35$^{th}$ embodiment of the invention.
Figure 69:
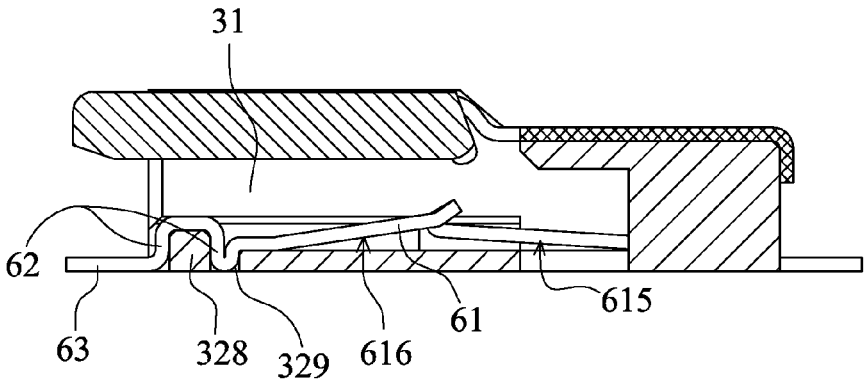
FIG. 69 is a cross-sectional side view showing the 35$^{th}$ embodiment of the invention.

As shown in FIG. 64, the 33$^{rd}$ embodiment of the invention is a DDR electrical connector including a plastic base 30 and two rows of terminals 60.

The plastic base 30 has a connection slot 31 and two rows of terminal slots 39.

The two rows of terminals 60 are disposed in the two rows of terminal slots 39. The terminal 60 has an elastic arm 61, a fixing portion 62 and a pin 63. The terminal 60 is longitudinally fixed to the plastic base 30. The elastic arm 61 is connected to the top end of the fixing portion 62 and extends upwards, and the rear section of the elastic arm is bent slantingly downwards. The distal-end cut surface of the elastic arm 61 has a connection point 64 projecting toward the connection slot 31.

Figure 65:
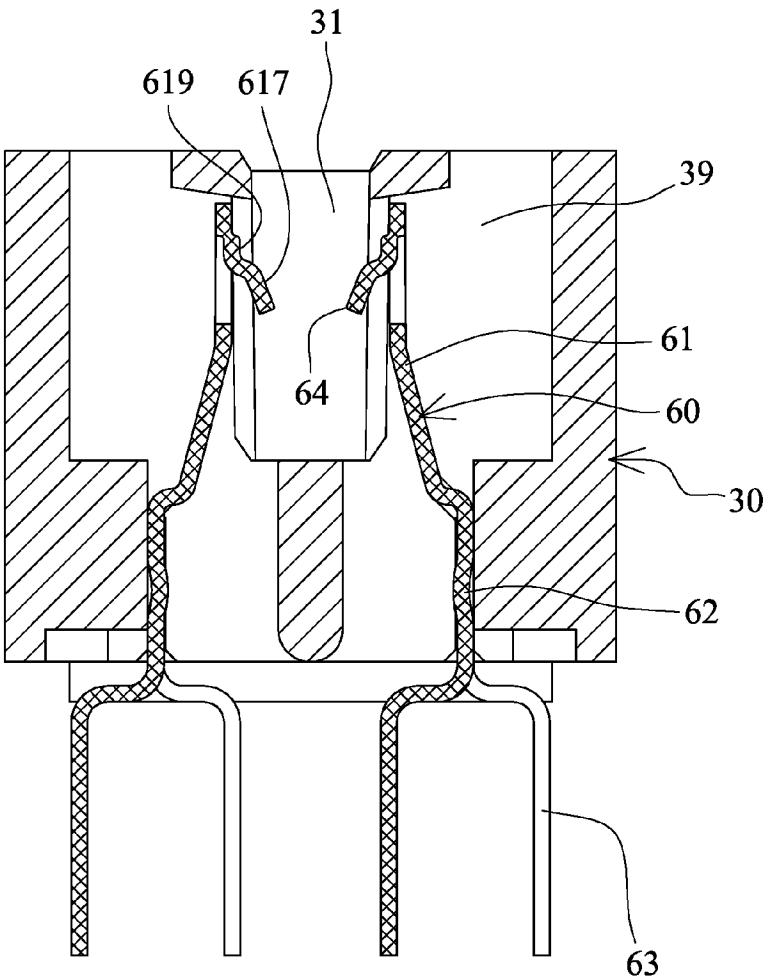
FIG. 65 is a cross-sectional side view showing a 34$^{th}$ embodiment of the invention.

As shown in FIG. 65, the 34$^{th}$ embodiment of the invention is a DDR electrical connector including a plastic base 30 and two rows of terminals 60, and is almost the same as the 33$^{rd}$ embodiment except for the difference that the rear section plate surface of the elastic arm 61 of the terminal 60 of this embodiment is punched and prodded to form a reversely projecting contact section 617. The contact section 617 is firstly punched to form a step 619 with the rear section plate surface of the elastic arm and is then prodded. The connection point 64 is disposed on the one edge connected between the distal-end cut surface of the contact section 617 and the plate surface of the elastic arm.

As shown in FIGS. 66 to 69, the 35$^{th}$ embodiment of the invention is a cable connector including a plastic base 30, one row of first terminals 615, one row of second terminals 616 and one row of elastic pressing sheets 120.

A cover 317 is disposed over the front section of the plastic base 30, and a metal casing 320 is disposed on the rear section of the plastic base 30. A connection slot 31 with an opening facing frontwards is formed between the cover 317 and the plastic base 30. A cable may be inserted into the connection slot 31. The cable has one row of connection points. Each of two sides of the metal casing 320 has a fixing hole 321 and a board bonding portion 322. The rear section of the plastic base 30 has one row of first terminal slots 326, and the front section of the plastic base 30 has one row of second terminal slots 327. Each of the first and second terminal slots 326 and 327 has a convex positioning structure 328. The bottom surface on the inner side of the convex positioning structure 328 of the second terminal slot 327 has a through hole 329. The cover 317 has a pivot portion 335 and a cam 318. The cover 317 can be pivotally rotated relatively to the plastic base 30. When the cover 317 is pivotally rotated, the cam 318 may tightly press against or be released from the cable.

The fixing holes 321 on the two sides of the metal casing 320 engage with the engagement blocks 324 on the two sides of the plastic base 30. The two board bonding portions 322 may be soldered to a circuit board to enhance the fixing of the overall electrical connector.

The one row of first terminals 615 are assembled, from top to bottom, into the one row of first terminal slots 326 of the plastic base 30. Each first terminal 615 is formed by bending the plate surface of the metal sheet, and sequentially has, from one end to the other end, an elastic arm 61, a fixing portion 62 and a pin 63. The fixing portion 62 has a curved shape to engage with the convex positioning structure 328. The elastic arm 61 extends toward the opening of the connection slot 31 and the rear section thereof is bent upwards away from the opening of connection slot 31. The bent portion of the elastic arm 41 has no elasticity and has a most upwardly projecting connection point 64. The connection point 64 is one edge connected between the distal-end cut surface of the elastic arm 61 and the plate surface of the elastic arm, is in the form of a tip point and projects toward the connection slot 31. When the connection point 64 is pressed, the elastic arm 61 elastically moves in the plate surface direction. The connection point 64 is electrically connected to the connection point of the cable, and the pin 63 horizontally extends out of the rear end of the plastic base 30.

The one row of second terminals 616 are assembled, from top to bottom, into the one row of second terminal slots 327 of the plastic base 30. Each second terminal 616 is formed by bending the plate surface of the metal sheet, and sequentially has, from one end to the other end, an elastic arm 61, a fixing portion 62 and a pin 63. The fixing portion 62 has a curved shape to engage with the convex positioning structure 328 and fall into the through hole 329. Thus, the fixing portion 62 engages with the convex positioning structure 328 by the longer length, and the elastic arm 61 extends away from the opening of the connection slot 31. The elastic arm 61 has the most upwardly projecting connection point 64. The connection point 64 is one edge connected between the distal-end cut surface of the elastic arm 61 and the plate surface of the elastic arm, is in the form of a tip point and projects toward the connection slot 31. When the connection point 64 is pressed, the elastic arm 41 elastically moves in the plate surface direction. The connection point 64 is electrically connected to the connection point of the cable, and the pin 63 extends out of the front end of the plastic base 30.

The connection points 61 of the one row of first terminals 615 and the connection points 61 of the one row of second terminals 616 are arranged alternately.

The one row of elastic pressing sheets 120 and the metal casing 320 are integrally formed by pressing the metal sheet. The one row of elastic pressing sheets 120 are disposed on the front end of the metal casing 320. Each elastic pressing sheet 120 has an elastic arm 121. The elastic arm 122 extends towards the opening of the connection slot 31 and has a pivot portion 123 pivotally connected to and elastically pressing the pivot portion 335 of the cover 317. When the cover 317 is pivotally rotated, the cam 318 may tightly press against the cable. The elastic arms 611 of the one row of first and second terminals 615 and 616 and the elastic arms 122 of the one row of elastic pressing sheets 120 respectively tightly press against the top and bottom surfaces of the cable. The elastic arms 61 of the one row of terminals 615 and 616 and the elastic arms 121 of the one row of elastic pressing sheets 120 can elastically move in the plate surface direction when being pressed by the cable.

Each of the connection points 64 of the first and second terminals 615 and 616 of this embodiment is the natural R-corner or the burrless chamfer formed during punching. In addition, the two sides of the rear section of the elastic arm connected to the connection point 64 are also the natural R-corners or burrless chamfers formed during punching. Thus, the poor contact, caused by the rugged burr, cannot occur during the electrical connection.

According to the above-mentioned structure, this embodiment has the advantages of the first embodiment as well as the following advantages.

1. The one row of elastic pressing sheets 120 and the metal casing are integrally formed, so that the plastic base 30 may be thinner, and the miniaturized product requirement can be further satisfied.

2. The first and second terminals 615 and 616 are arranged in the front-to-rear direction so that the product with the smaller terminal gap can be disposed.

3. The first and second terminals engage with the convex positioning structure 328 of the plastic base 30 to enhance the fixing effect, and the fixing portion 62 of the second terminal may fall into the through hole 329. Thus, the fixing portion 62 engages with the convex positioning structure 328 by the longer length.

4. The first and second terminals engage, from top to bottom, with the plastic base 30. The first and second terminals may be supported by the plastic base 30. The first and second terminals elastically move downwards when being pressed, so that the stability is better.

5. The one row of elastic pressing sheets 120 pivotally connected to and elastically pressing the cover 317 can make the positioning and pivotal rotation of the cover 317 become smoother.

6. Each of the two sides of the metal casing 320 has one board bonding portion 322 for bonding and fixing, so the metal casing 320 can further withstand the stress occurred when the cover 317 is pivotally rotated.

In each of the $27^{th}$ to $35^{th}$ embodiments, the cover 317 is pivotally connected to the one row of elastic pressing sheets 120. However, the cover 317 may also be pivotally connected to the plastic base 30, and the one row of elastic pressing sheets 120 only make the elastic pressing but no pivotal connection.

Figure 70:
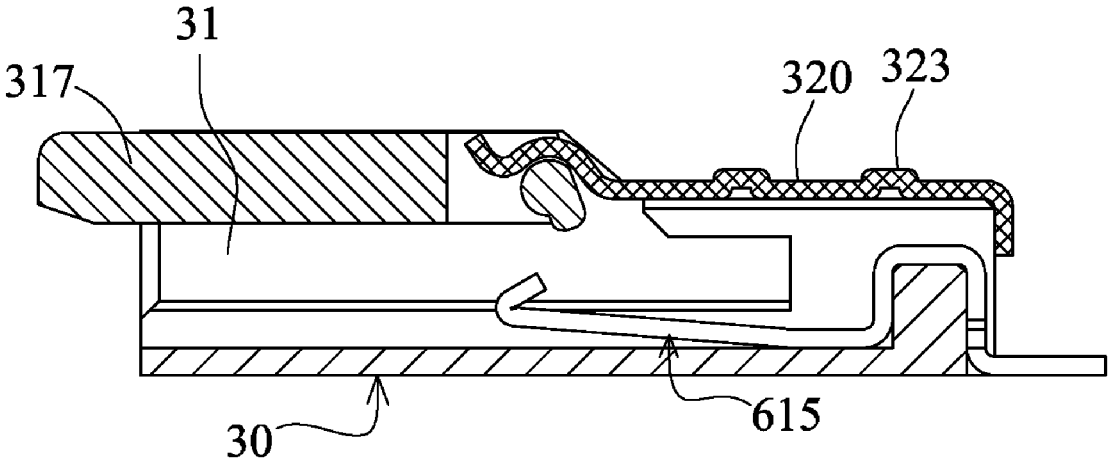
FIG. 70 is a cross-sectional side view showing a 36$^{th}$ embodiment of the invention.

As shown in FIG. 70, the $36^{th}$ embodiment of the invention is almost the same as the $35^{th}$ embodiment except for the difference that the metal casing 320 of this embodiment has two ribs 323 for strengthening the structural strength of the plate surface, and that only one row of first terminals 615 are provided.

Figure 71:
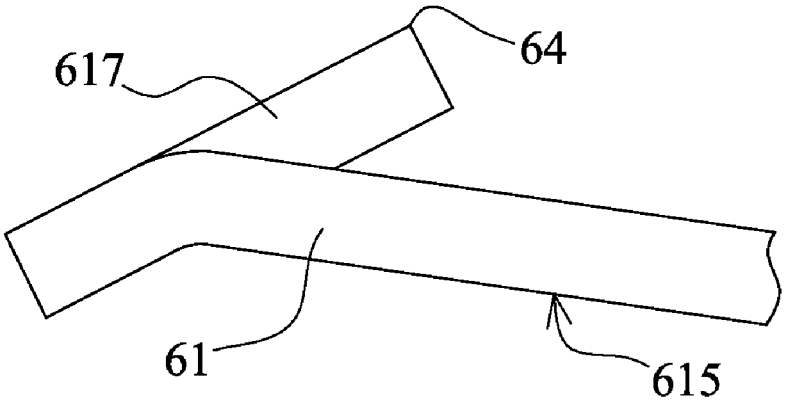
FIG. 71 is a side view showing a terminal according to a 37$^{th}$ embodiment of the invention.

As shown in FIG. 71, the $37^{th}$ embodiment of the invention is almost the same as the $35^{th}$ and $36^{th}$ embodiments except for the difference that the rear section plate surface of the elastic arm 61 of the first terminal 615 of this embodiment is prodded to form a reversely projecting contact section 617. The connection point 64 is disposed on the one edge connected between the distal-end cut surface of the contact section 617 and the plate surface of the elastic arm.

Figure 72:
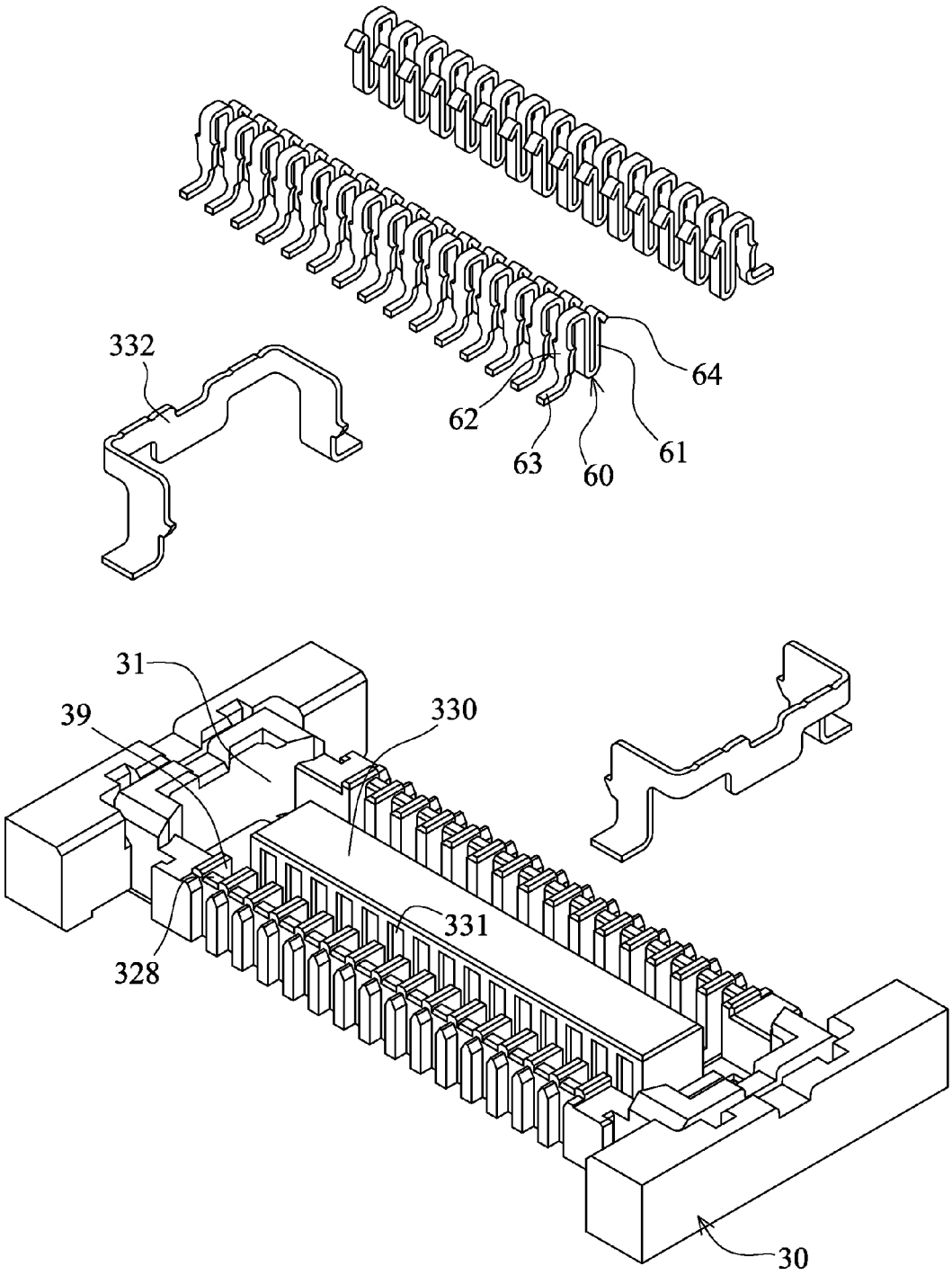
FIG. 72 is a pictorially exploded view showing a 38$^{th}$ embodiment of the invention.
Figure 73:
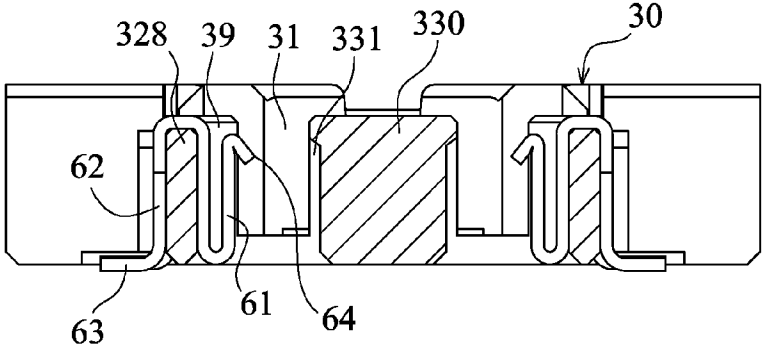
FIG. 73 is a cross-sectional side view showing the 38$^{th}$ embodiment of the invention.

As shown in FIGS. 72 and 73, the $38^{th}$ embodiment of the invention is a plate-to-plate electrical connector including a plastic base 30 and two rows of terminals 60.

The plastic base 30 has a connection slot 31. The middle of the connection slot 31 has a projection 330, and each of two sides of the connection slot has one row of terminal slots 39. The terminal slot 39 has a convex positioning structure 328.

Each of two sides of the projection 330 has one row of slots 331. Each of two corresponding ends of the plastic base 30 has a board bonding element 332.

The two rows of terminals 60 are assembled, from top to bottom, into the two rows of terminal slots 39 of the plastic base 30. The terminal 60 is formed by bending the plate surface of the metal sheet, and sequentially has, from one end to the other end, an elastic arm 61, a fixing portion 62 and a pin 63. The fixing portion 62 has a curved shape to engage with the convex positioning structure 328. The elastic arm 61 is connected to the fixing portion 62 and extends upwards from the bottom end of the plastic base. The rear section of the elastic arm 61 is bent slantingly downwards. The bent portion of the elastic arm 61 has no elasticity and has a connection point 64 mostly projecting toward the connection slot 31. The connection point 64 is one edge connected between the distal-end cut surface of the elastic arm 61 and the plate surface of the elastic arm and is in the form of a tip point. When the connection point 64 is pressed, the elastic arm 61 elastically moves in the plate surface direction. The pin 63 horizontally extends out of one side of the plastic base 30.

The connection point 64 of the terminal 60 of this embodiment is the natural R-corner or burrless chamfer formed during punching. In addition, the two sides of the rear section of the elastic arm connected to the connection point 64 are natural R-corners or burrless chamfers formed during punching. Thus, the poor contact, caused by the rugged burr, cannot occur during the electrical connection.

Figure 74:
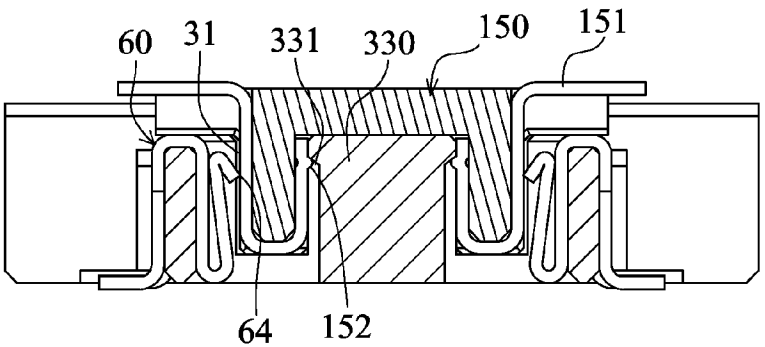
FIG. 74 shows the usage state of the 38$^{th}$ embodiment of the invention.

As shown in FIG. 74, when an oppositely connected plate-to-plate electrical connector 150 is inserted into the connection slot 31, the connection points 64 of the two rows of terminals 60 are electrically connected to the two rows of terminals 151 of the plate-to-plate electrical connector 150, and the engagement points 152 of the two rows of terminals 151 engage with the two rows of slots 331 on two sides of the projection 330 so that the two plate-to-plate connectors engage with each other.

Figure 75:
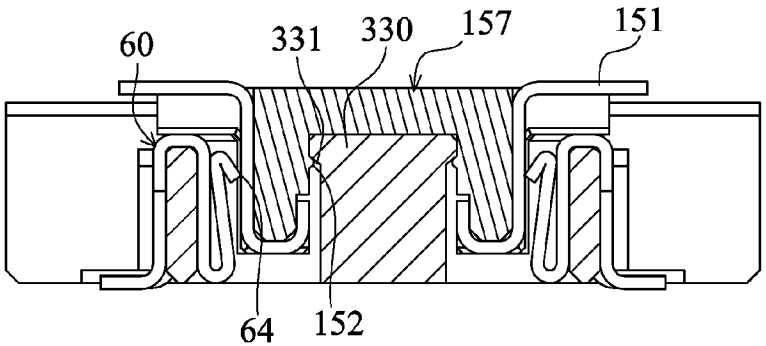
FIG. 75 shows the usage state of the 38$^{th}$ embodiment of the invention.

As shown in FIG. 75, an oppositely connected plate-to-plate electrical connector 157 has two rows of plastic engagement points 152. When the plate-to-plate electrical connector 157 is inserted into the connection slot 31, the connection points 64 of the two rows of terminals 60 are electrically connected to the two rows of terminals 151 of the plate-to-plate electrical connector 157, and the two rows of engagement points 152 engage with the two rows of slots 331 on two sides of the projection 330.

Figure 76:
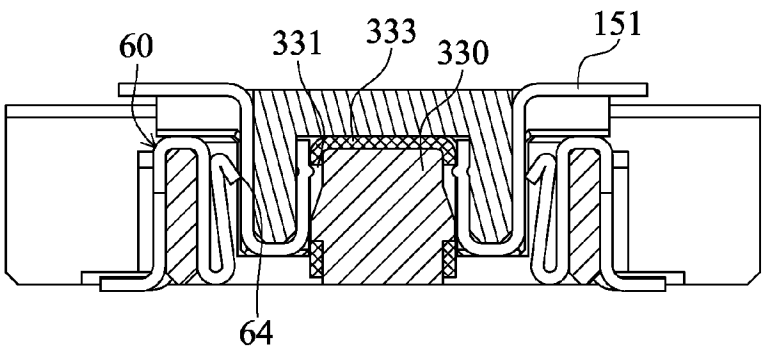
FIG. 76 shows the usage state of a 39$^{th}$ embodiment of the invention.

As shown in FIG. 76, the 39$^{th}$ embodiment of the invention is almost the same as 38$^{th}$ embodiment except for the difference that a metal member 333 covers the projection 330 of the middle of the connection slot 31 of the plastic base 30 of this embodiment. When an oppositely connected plate-to-plate electrical connector 150 is inserted into the connection slot 31, the connection points 64 of the two rows of terminals 60 are electrically connected to the two rows of terminals 151 of the plate-to-plate electrical connector 150, and the engagement points 152 of the two rows of terminals 151 engage with the metal member 333.

Figure 77:
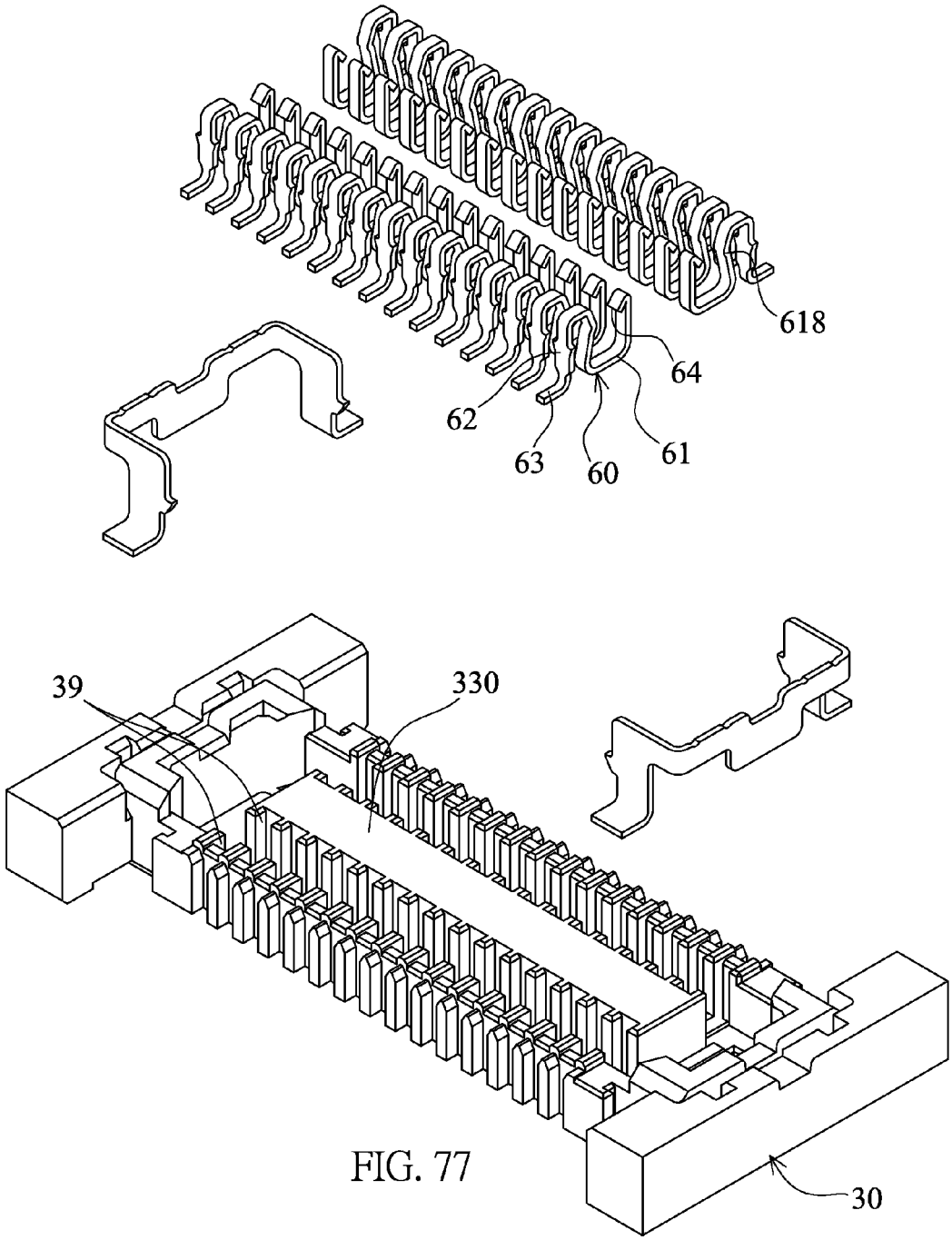
FIG. 77 is a pictorially exploded view showing a 40$^{th}$ embodiment of the invention.
Figure 78:
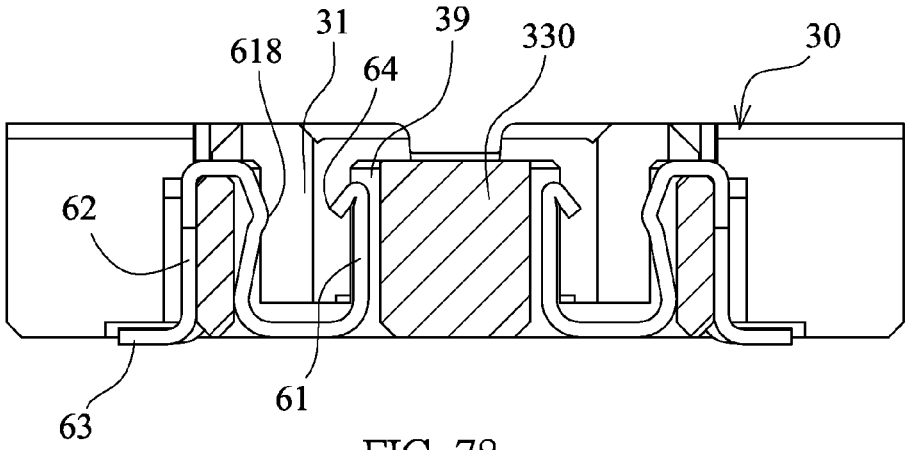
FIG. 78 is a cross-sectional side view showing the 40$^{th}$ embodiment of the invention.

As shown in FIGS. 77 and 78, the 40$^{th}$ embodiment of the invention is almost the same as the 38$^{th}$ embodiment except for the difference that the two rows of terminal slots 39 of the plastic base 30 of this embodiment extend to one side of the projection 330 of the middle of the connection slot 31, and the elastic arms 61 of the two rows of terminals 60 extend to one side of the projection 330. Thus, the elastic arm 61 of the terminal is longer to have the better elasticity. In addition, the fixing portion 62 has an engagement point 618, which may engage with an oppositely connected plate-to-plate electrical connector.

Figure 79:
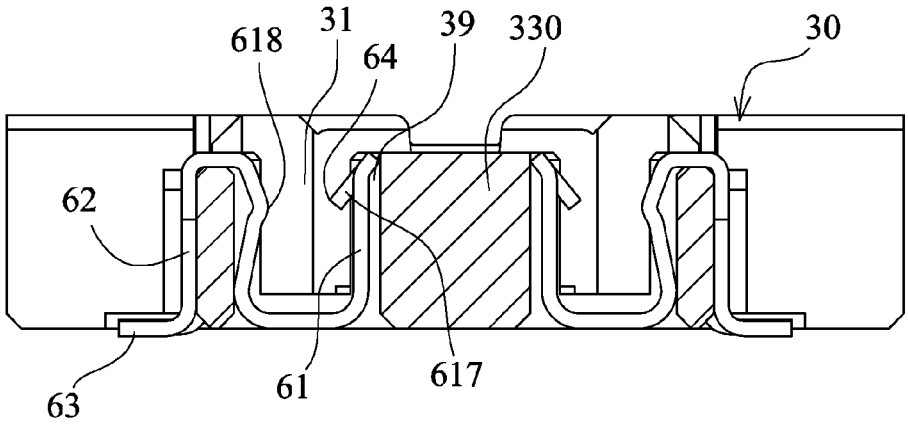
FIG. 79 is a cross-sectional side view showing a 41$^{st}$ embodiment of the invention.

As shown in FIG. 79, the 41$^{st}$ embodiment of the invention is almost the same as the 40$^{th}$ embodiment except for the difference that the rear section plate surface of the elastic arm 61 of the two rows of terminals 60 of this embodiment is prodded to form a reversely projecting contact section 617 toward the connection slot 31. The connection point 64 is disposed on one edge connected between the distal-end cut surface of the contact section 617 and the plate surface of the elastic arm.

Figure 80:
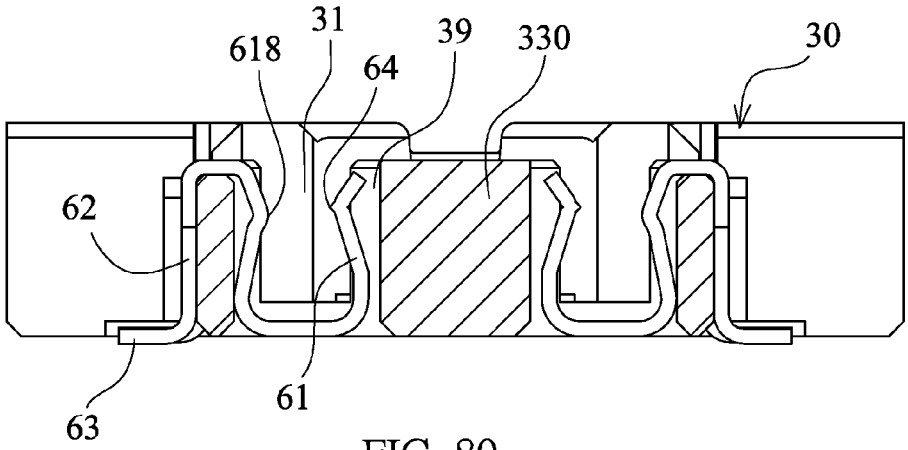
FIG. 80 is a cross-sectional side view showing a 42$^{nd}$ embodiment of the invention.

As shown in FIG. 80, the 42$^{nd}$ embodiment of the invention is almost the same as the 40$^{th}$ embodiment except for the difference that the connection points 64 of the two rows of terminals 60 of this embodiment are formed by bending the plate surface of the elastic arm 61. The connection point 64 projects to the connection slot 31, and the plate surface of the elastic arm 61 is pressed into the R-corner (arc with the radius R) and is in the form of a tip point so that the better scratching effect is obtained.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electrical connector to be electrically connected to an electrical device, the electrical connector comprising:

a plastic base having a connection slot; and at least one row of terminals disposed in the plastic base, wherein each of the terminals is formed by bending a plate surface of a metal sheet, and has an elastic arm, a fixing portion and a pin, the fixing portion is fixed to the plastic base, the elastic arm has one end connected to the fixing portion and a connection point disposed in the connection slot, and the pin extends out of the base;

wherein a cut surface of the elastic arm forms the connection point, the connection point is disposed on a free end of the elastic arm, and when the electrical device is placed into the connection slot and electrically connected to the connection point, the connection point is directly pressed by the electrical device to make the elastic arm elastically move in a plate surface direction.

2. The electrical connector according to claim 1, wherein two sides of the plastic base have two lateral arms, the two lateral arms extend in a direction toward an opening of the connection slot, a fastener is disposed near an outer end of each of the two lateral arms, the electrical device is a circuit board, and the fastener engages with one side of the circuit board when the circuit board is inserted into the connection slot for positioning.

3. The electrical connector according to claim 1, wherein the connection point of the terminal is disposed on a distal-end cut surface of the elastic arm of the terminal.

4. The electrical connector according to claim 1, wherein the connection point of the terminal is one edge connected between a distal-end cut surface and a plate surface of the elastic arm of the terminal.

5. The electrical connector according to claim 4, wherein the connection point of the terminal is a natural arc with a radius or a burrless chamfer formed during punching.

6. The electrical connector according to claim 4, wherein each of two sides of a rear section of the elastic arm connected to the connection point is a natural arc with a radius or a burrless chamfer formed during punching.

7. The electrical connector according to claim 1, wherein an opening of the connection slot of the plastic base faces frontwards, the at least one row of terminals comprise one row of first terminals and one row of second terminals, the second terminal has the connection point projecting upwards, and the first terminal has the connection point projecting downwards and disposed above the connection point of the second terminal.

8. The electrical connector according to claim 7, wherein the connection point of the first terminal is further disposed behind the connection point of the second terminal.

9. The electrical connector according to claim 7, wherein the connection slot has a card-ejecting inclined surface, the electrical device is a circuit board, and when the circuit board is slantingly inserted into the connection slot and then pressed downwards to be horizontal, the circuit board is ejected by a stroke along the card-ejecting inclined surface.

10. The electrical connector according to claim 1, wherein the elastic arm of the terminal extends toward an opening of the connection slot, a rear section of the elastic arm is bent and away from the opening of the connection slot, and a bent portion of the elastic arm has no elasticity.

11. The electrical connector according to claim 10, wherein the opening of the connection slot faces frontwards, the fixing portion of the terminal extends horizontally frontwards, the rear section of the elastic arm is bent and projects toward the connection slot, and the pin extends out of a rear end of the plastic base.

12. The electrical connector according to claim 10, wherein the opening of the connection slot faces frontwards, the fixing portion of the terminal extends horizontally backwards, the elastic arm is bent and extends frontwards from the fixing portion, the rear section of the elastic arm is bent upwards, and the pin extends out of a front end of the plastic base.

13. The electrical connector according to claim 1, wherein a plate surface of a rear section of the elastic arm of the terminal is prodded to form a reversely projecting contact section, and the connection point is disposed on a distal-end cut surface of the contact section.

14. The electrical connector according to claim 1, wherein an opening of the connection slot faces frontwards, the fixing portion of the terminal extends horizontally backwards, the elastic arm has a first elastic arm and a second elastic arm, the second elastic arm is connected to the fixing portion and extends backwards, the first elastic arm is bent from the second elastic arm and extends frontwards, a rear section of the first elastic arm is bent upwards and away from the opening of the connection slot, a bent portion of the first elastic arm has no elasticity, and the pin horizontally extends out of a front end of the plastic base.

15. The electrical connector according to claim 3, wherein a middle of the distal-end cut surface of the elastic arm of the terminal has a projection.

16. The electrical connector according to claim 1, wherein the fixing portion of the terminal extends longitudinally.

17. The electrical connector according to claim 16, wherein the electrical device is a chip, the plastic base has multiple rows of matrix-arranged terminal slots, the terminal slot has opposite first and second walls, the at least one row of terminals comprise multiple rows of terminals, each of which is disposed in the terminal slot, the fixing portion of the terminal rests against the first wall, and an opening of the connection slot faces upwards and can accommodate the chip.

18. The electrical connector according to claim 17, wherein a distal end of the elastic arm of the terminal passes through the second wall and goes to a position above the neighboring terminal slot.

19. The electrical connector according to claim 17, wherein the elastic arm of the terminal firstly extends near the second wall and then turns back to make a distal end of the elastic arm pass through the first wall and go to a position above the neighboring terminal slot.

20. The electrical connector according to claim 17, further comprising an upper cover, an external seat and a lever, wherein the plastic base is accommodated within the external seat, a rear end of the upper cover is pivotally connected to a rear end of the external seat, a front end of the upper cover has a transversally projecting tab facing frontwards, the upper cover can press the chip down when the upper cover covers the plastic base, the lever has a first rod and a second rod, which are perpendicular to each other, the second rod is pivotally connected to a front end of the external seat and is curved to form a projecting rod, and the projecting rod can press the tab of the upper cover when the first rod is swung toward a rear end of the plastic base.

21. The electrical connector according to claim 1, wherein the at least one row of terminals comprise two rows of terminals, the connection points of the two rows of terminals are disposed in a front-to-rear direction and project in the same direction, and an opening of the connection slot faces frontwards.

22. The electrical connector according to claim 1, wherein the electrical device is a cable, an opening of the connection slot faces frontwards, the cable may be inserted into the opening of the connection slot, the cable has one row of connection points and further has one row of elastic pressing sheets, each of the elastic pressing sheets has an elastic arm elastically pressing the cable, the elastic arms of the at least one row of terminals and the elastic arms of the one row of elastic pressing sheets respectively tightly press against top and bottom surfaces of the cable, and the elastic arms of the at least one row of terminals and the elastic arms of the one row of elastic pressing sheets elastically move in the plate surface direction when being pressed by the cable.

23. The electrical connector according to claim 22, wherein a cover is disposed above the plastic base, the one row of elastic pressing sheets press the cover, the cover has a cam, the cover can be pivotally rotated relatively to the plastic base, and when the cover is pivotally rotated, the cam can tightly press against or release from the cable.

24. The electrical connector according to claim 23, wherein the elastic pressing sheet has a pivot portion pivotally connected to the cover.

25. The electrical connector according to claim 22, wherein the plastic base has a sliding sheet, the sliding sheet can slide into the connection slot, and the one row of elastic pressing sheets press the sliding sheet and indirectly tightly press against the cable.

26. The electrical connector according to claim 22, wherein each of the elastic pressing sheets is formed by bending a plate surface of a metal sheet and further has a fixing portion fixed to the plastic base.

27. The electrical connector according to claim 22, further comprising a metal casing covering the plastic base, wherein the one row of elastic pressing sheets and the metal casing are integrally formed by pressing a metal material.

28. The electrical connector according to claim 27, wherein a lateral side of the metal casing has a board bonding portion.

29. The electrical connector according to claim 22, wherein the at least one row of terminals comprise one row of first terminals and one row of second terminals, the elastic arm of the first terminal extends toward the opening of the connection slot, the elastic arm of the second terminal extends away from the opening of the connection slot, and the connection points of the one row of first terminals and the connection points of the one row of second terminals are arranged alternately in the same row.

30. The electrical connector according to claim 1, wherein the at least one row of terminals comprise two rows of terminals, the two rows of terminals are fixed to two sides of the connection slot, and the elastic arms of the two rows of terminals extend upwards from a portion near a bottom end of the plastic base.

31. The electrical connector according to claim 1, wherein the plastic base has a convex positioning structure, and the fixing portion of the terminal has a curved shape and engages with the convex positioning structure.

32. The electrical connector according to claim 31, wherein an inner bottom surface of the convex positioning structure of the plastic base has a through hole, and the fixing portions of the at least one row of terminals fall into the through hole.

33. The electrical connector according to claim 1, wherein the at least one row of terminals are assembled, from top to bottom, into the plastic base, and the fixing portions of the at least one row of terminals engage with the plastic base.

* * * * *